US011066917B2

(12) United States Patent
Jain et al.

(10) Patent No.: US 11,066,917 B2
(45) Date of Patent: Jul. 20, 2021

(54) EARTH-BORING TOOL RATE OF PENETRATION AND WEAR PREDICTION SYSTEM AND RELATED METHODS

(71) Applicant: Baker Hughes Holdings LLC, Houston, TX (US)

(72) Inventors: Jayesh Rameshlal Jain, The Woodlands, TX (US); John Abhishek Raj Bomidi, Spring, TX (US); Xu Huang, Spring, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 565 days.

(21) Appl. No.: 15/976,330

(22) Filed: May 10, 2018

(65) Prior Publication Data

US 2019/0345809 A1 Nov. 14, 2019

(51) Int. Cl.
*E21B 44/00* (2006.01)
*E21B 44/02* (2006.01)
(Continued)

(52) U.S. Cl.
CPC ..... *E21B 44/02* (2013.01); *E21B 21/08* (2013.01); *E21B 45/00* (2013.01); *E21B 47/26* (2020.05);
(Continued)

(58) Field of Classification Search
CPC . E21B 7/00; E21B 44/02; E21B 47/26; E21B 21/08; E21B 49/003; E21B 45/00;
(Continued)

(56) References Cited

U.S. PATENT DOCUMENTS 7,604,072 B2 10/2009 Pastusek et al.
7,849,934 B2 12/2010 Pastusek et al.
(Continued)

FOREIGN PATENT DOCUMENTS

WO WO 2013/019223 A1 * 2/2013 ..... E21B 47/022
WO WO 2014/066981 A1 * 5/2014 ..... E21B 7/00
(Continued)

OTHER PUBLICATIONS

International Search Report for International Application No. PCT/US2019/031716 dated Aug. 22, 2019, 3 pages.
(Continued)

*Primary Examiner* — Kandasamy Thangavelu
(74) *Attorney, Agent, or Firm* — TraskBritt

(57) ABSTRACT

An earth-boring tool system that includes a drilling assembly for drilling a wellbore and a surface control unit. The surface control unit includes a prediction system that is configured to train a hybrid physics and machine-learning model based on input data, provide, via the hybrid model, a predictive model representing a rate of penetration of an earth-boring tool and wear of the earth-boring tool during a planned drilling operation, provide one or more recommendations of drilling parameters based on the predictive model, utilize the one or more recommendations in a drilling operation, receive real-time data from the drilling operation, retrain the hybrid model based on a combination of the input data and the real-time data, and provide, via the retrained model, an updated predictive model of a rate of penetration of an earth-boring tool and wear of the earth-boring tool during a remainder of the planned drilling operation.

20 Claims, 10 Drawing Sheets

(51) Int. Cl.

| | |
|---|---|
| ***E21B 21/08*** | (2006.01) |
| ***E21B 49/00*** | (2006.01) |
| ***E21B 45/00*** | (2006.01) |
| ***E21B 47/26*** | (2012.01) |

(52) U.S. Cl.
CPC ..... *E21B 49/003* (2013.01); *E21B 2200/22* (2020.05)

(58) Field of Classification Search
CPC ..... E21B 2200/22; E21B 44/005; E21B 7/06; E21B 10/00; E21B 21/06; E21B 41/00; E21B 44/00; E21B 47/00; E21B 47/022; E21B 49/00; E21B 49/08; G01V 1/44; G01V 1/30; G01V 1/306; G06F 3/1454; G06F 30/20; G06F 17/18; G06F 17/5009; G06F 19/00; G05B 19/02; G06N 99/005
See application file for complete search history.

(56) References Cited

U.S. PATENT DOCUMENTS

| | | | | |
|---|---|---|---|---|
| 8,100,196 | B2 | 1/2012 | Pastusek et al. | |
| 8,417,495 | B2 * | 4/2013 | Dashevskiy | E21B 44/00 703/7 |
| 2014/0122034 | A1 | 5/2014 | Hanson et al. | |
| 2014/0351183 | A1 * | 11/2014 | Germain | E21B 44/00 706/12 |
| 2015/0218914 | A1 | 8/2015 | Marx et al. | |
| 2015/0300151 | A1 | 10/2015 | Mohaghegh | |
| 2016/0047206 | A1 * | 2/2016 | Vempati | E21B 7/00 703/7 |
| 2016/0117424 | A1 * | 4/2016 | Hohl | E21B 7/00 703/2 |
| 2017/0058658 | A1 * | 3/2017 | Spencer | G06F 30/20 |
| 2017/0352169 | A1 * | 12/2017 | Flanagan | G06F 3/1454 |
| 2018/0025269 | A1 | 1/2018 | Dursun et al. | |
| 2018/0106147 | A1 * | 4/2018 | Lakings | G01V 1/44 |

FOREIGN PATENT DOCUMENTS

| | | | | |
|---|---|---|---|---|
| WO | WO 2016/057030 | A1 * | 4/2016 | G06F 19/00 |
| WO | WO 2016/160005 | A1 * | 10/2016 | G06G 7/48 |
| WO | WO 2016/200379 | A1 * | 12/2016 | E21B 21/06 |
| WO | WO 2017/116417 | A1 * | 7/2017 | G06F 19/00 |
| WO | WO 2017/214316 | A1 * | 12/2017 | E21B 49/00 |
| WO | WO 2018/0038963 | A1 * | 3/2018 | E21B 7/02 |
| WO | WO 2018/067131 | A1 * | 4/2018 | |

OTHER PUBLICATIONS

International Written Opinion for International Application No. PCT/US2019/031716 dated Aug. 22, 2019, 6 pages.
Crry et al, Methods and Systems for Drilling Boreholes in Earth Formations, U.S. Appl. No. 15/373,036, filed Dec. 8, 2016.

* cited by examiner

EARTH-BORING TOOL RATE OF PENETRATION AND WEAR PREDICTION SYSTEM AND RELATED METHODS

TECHNICAL FIELD

This disclosure relates generally to earth-boring tool rate of penetration and wear prediction systems and methods of using such systems.

BACKGROUND

Oil wells (wellbores) are usually drilled with a drill string. The drill string includes a tubular member having a drilling assembly that includes a single drill bit at its bottom end. The drilling assembly may also include devices and sensors that provide information pertaining to a variety of parameters relating to the drilling operations ("drilling parameters"), behavior of the drilling assembly ("drilling assembly parameters") and parameters relating to the formations penetrated by the wellbore ("formation parameters"). A drill bit and/or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

Conventional methods of predicting and optimizing bit performance utilize physics-based models during pre-well planning. While the physics models can describe the fundamental mechanics and can predict laboratory performance, the physics models lack sufficient calibration to predict field-specific behavior accurately. Moreover, unknown factors and uncertainties that are not conventionally included in the physics models introduce errors to any predictions. Moreover, the most comprehensive and accurate conventional physics models are too slow for real-time predictions.

Conventional data analytics and machine-learning models, on the other hand, have the ability to handle uncertainties and produce results fast enough for real-time predictions. However, training the machine-learning models requires a relatively large amount of data from offset wells. This results in any predictions being useful only in later wells. Moreover, introductions of new variables, new designs, new conditions, etc., that were previously unseen in the offset data, which is common in oilfield drilling, render predictions inaccurate.

BRIEF SUMMARY

Some embodiments of the present disclosure include a method of providing predictive models of rates of penetration and wear of an earth-boring tool during a planned drilling operation. The method may include receiving input data and training a hybrid physics and machine-learning model with the input data by building a coefficient library of drilling parameters of a planned drilling operation. Building the coefficient library may include determining initial predictions of the drilling parameters of the planned drilling operation based on physics data within the input data and determining relative influences and rankings of the drilling parameters the planned drilling operation based on the physics data. The method may further include providing, via the hybrid physics and machine-learning model, a predictive model representing a rate of penetration of an earth-boring tool and wear of the earth-boring tool during the planned drilling operation.

In additional embodiments, the present disclosure includes an earth-boring tool system. The earth-boring tool system may include a drilling assembly for drilling a wellbore and a surface control unit operably coupled to the drilling assembly. The surface control unit may include a prediction system that includes at least one processor and at least one non-transitory computer-readable storage medium storing instructions thereon that, when executed by the at least one processor, cause the prediction system to: pre-train a plurality of modules individually within a hybrid physics and machine-learning model; train the plurality of modules together to develop the hybrid physics and machine-learning model based on input data; provide, via the hybrid physics and machine-learning model, a predictive model representing a rate of penetration of an earth-boring tool and wear of the earth-boring tool during a planned drilling operation, provide one or more recommendations of drilling parameters based on the predictive model, utilize the one or more recommendations in a drilling operation, receive real-time data from the drilling operation, retrain the hybrid physics and machine-learning model based on a combination of the input data and the real-time data; provide, via the retrained hybrid physics and machine-learning model, an updated predictive model of a rate of penetration of the earth-boring tool and wear of the earth-boring tool during a remainder of the planned drilling operation.

Some embodiments of the present disclosure include a method of providing predictive models of rates of penetration and wear of an earth-boring tool during a planned drilling operation. The method may include receiving real-time data from a drilling operation at a trained hybrid physics and machine-learning model, analyzing the real-time data via the hybrid physics and machine-learning model, providing, via the hybrid physics and machine-learning model and based at least partially on the analysis, a predictive model representing a rate of penetration of an earth-boring tool and wear of the earth-boring tool throughout at least part of a remainder of the drilling operation, providing one or more recommendations of drilling parameters based on the predictive model, and operating at least a portion of the drilling operation using the one or more recommendations of drilling parameters.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
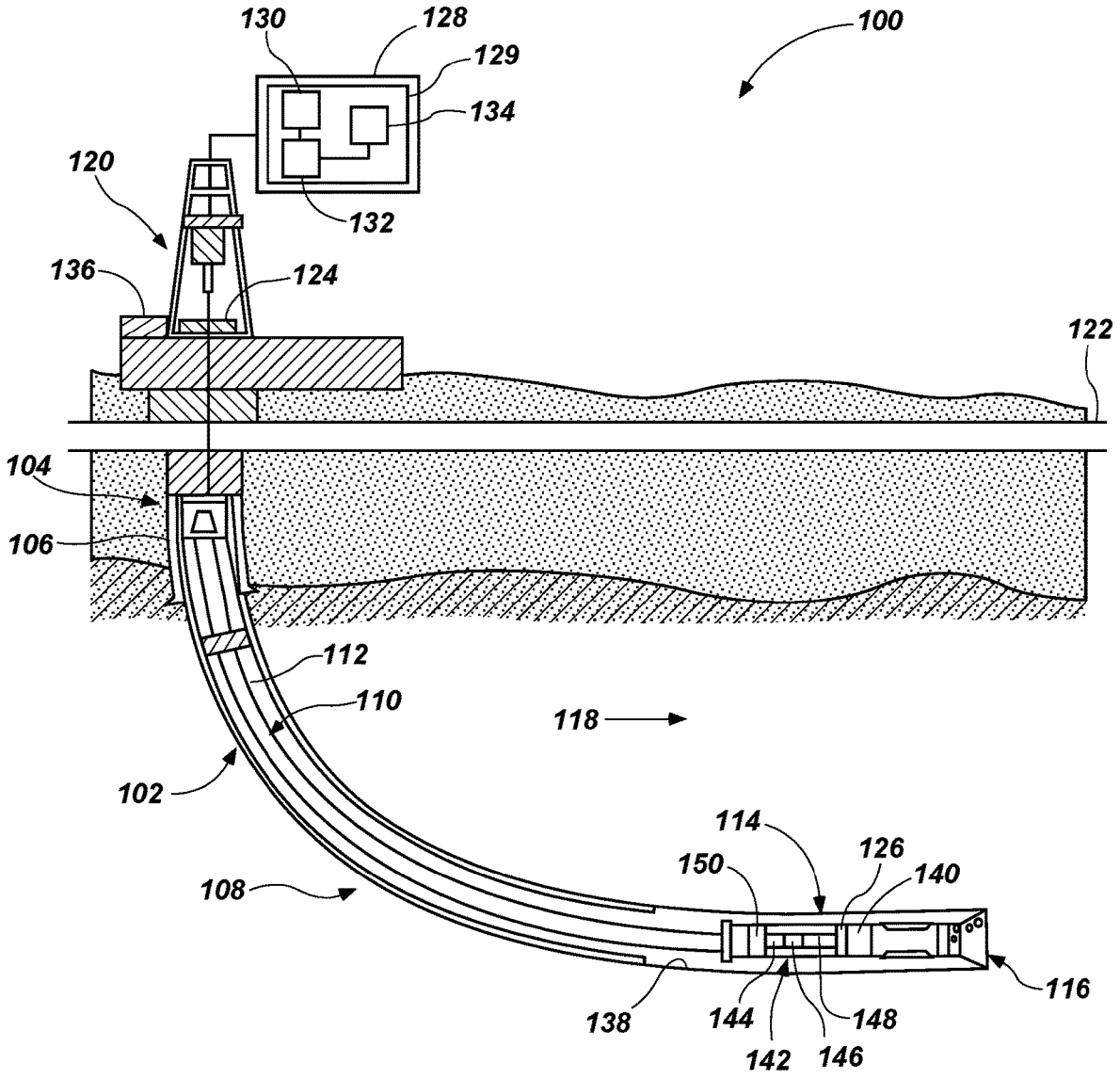
FIG. 1 is a schematic diagram of a wellbore system comprising a drill string that includes an earth-boring tool according to one or more embodiments of the present disclosure.

The illustrations presented herein are not actual views of any drilling system, earth-boring tool monitoring system, or any component thereof, but are merely idealized representations, which are employed to describe embodiments of the present invention.

As used herein, the terms "bit" and "earth-boring tool" each mean and include earth-boring tools for forming, enlarging, or forming and enlarging a borehole. Non-limiting examples of bits include fixed-cutter (drag) bits, fixed-cutter coring bits, fixed-cutter eccentric bits, fixed-cutter bi-center bits, fixed-cutter reamers, expandable reamers with blades bearing fixed cutters, and hybrid bits including both fixed cutters and rotatable cutting structures (roller cones).

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when disposed as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

Some embodiments of the present disclosure include a bit rate of penetration and wear prediction system (hereinafter "prediction system") for drilling optimization during pre-well planning as well as real-time drilling. The prediction system combines strengths of physics-based models with strengths of machine-learning models to form a hybrid physics and machine-learning model, which provides predictive rates of penetration and wear models for earth-boring tools and planned drilling operations. In particular, the prediction system integrates data (e.g., knowledge and understanding) obtained from theory and laboratory testing from the physics-based models into a hybrid machine-learning framework that utilizes field experience captured using data analytics. As a result, the predictions system provides a fast and accurate hybrid model that requires relatively minimal offset data and which has the ability to account for introductions of new variables, conditions, and uncertainties.

In some embodiments, the hybrid model includes one or more physics models, which include drill bit mechanics simulation models ("mechanics models"). The mechanics models include detailed three-dimensional geometry descriptions, rock failure models, cutter wear progression models, cutter fracture criteria, and other phenomena that affect wear and rate of penetration of an earth-boring tool. As will be appreciated by one of ordinary skill in the art, the foregoing models may be developed over a relatively long period of time (e.g., several years) based on theory and laboratory experimentation. The prediction system may identify coefficients used in the foregoing models (i.e., the analytical and numerical models) that may not be precisely known for a given field application. Additionally, the prediction system may determine the dependence of these coefficients on cutter type, rock formation, and other environmental factors. Then, the prediction system may determine (e.g., establish) initial estimates, upper and lower bounds, and relative rankings of the coefficients in various scenarios. The prediction system feeds the foregoing information to the machine-learning models of the hybrid models that conduct model training based on input data from offset wells. The machine-learning models of the hybrid models also determine (e.g., capture) influence of unaccounted influencing factors in complementary black-box models. Such factors may include measured parameters such as bottom-hole-assemblies, wellbore profiles, vibrations, drilling crew, and rig, as well as unmeasured parameters such as wellbore quality.

Additionally, some embodiments of the present disclosure include a hybrid model that, in comparison to conventional prediction systems, provides more accurate predictions with effective treatment of uncertainties. Moreover, the hybrid system requires less offset well data to provide accurate predictive models and can account for new variables. The hybrid system provides predictive models fast enough to enable real-time decision during drilling operations. Likewise, the predictive models generated by the hybrid model follow fundamental drilling principles and laws of physics.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at the surface 122. The rig 120 shown is a land rig 120 for ease of explanation. However, the apparatuses and methods disclosed may also be used with an offshore rig 120 that is used for drilling boreholes under water. A rotary table 124 or a top drive may be coupled to the drill string 110 and may be utilized to rotate the drill string 110 and to rotate the drilling assembly 114, and thus the drill bit 116, to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth, formation lithology, etc.

In some embodiments, the surface control unit 128 may include an earth-boring tool rate of penetration ("ROP") and wear prediction system 129 (referred to hereinafter as "prediction system 129"). The prediction system 129 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disc. Additionally, the surface control unit 128 may further include one or more devices for presenting output to an operator of the drilling assembly 114, including, but not limited to, a graphics engine, a display (e.g., a display screen), one or more output drivers (e.g., display drivers), one or more audio speakers, and one or more audio drivers. In certain embodiments, the surface control unit 128 is configured to provide graphical data to a display for presentation to an operator. The graphical data may be representative of one or more graphical user interfaces and/or any other graphical content as may serve a particular implementation. As is described in greater detail in regard to FIGS. 2-4C, the prediction system 129 may generate predictive ROP and wear models based on offset well data and physics data and utilizing physics model and machine-learning techniques. Furthermore, although the prediction system 129 is described herein as being part of the surface control unit 128, the disclosure is not so limited; rather, as will be understood by one of ordinary skill in the art, the prediction system 129 may be discrete from the surface control unit 128 and may be disposed anywhere within the drilling assembly 114 or may be remote to the drilling assembly 114. The surface control unit 128 and the prediction system 129 are described in greater detail below with reference to FIG. 5.

During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body of the drill bit 116). In some embodiments, the controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 and the earth-boring tool wear prediction system 129 via a two-way telemetry unit 150.

Figure 2:
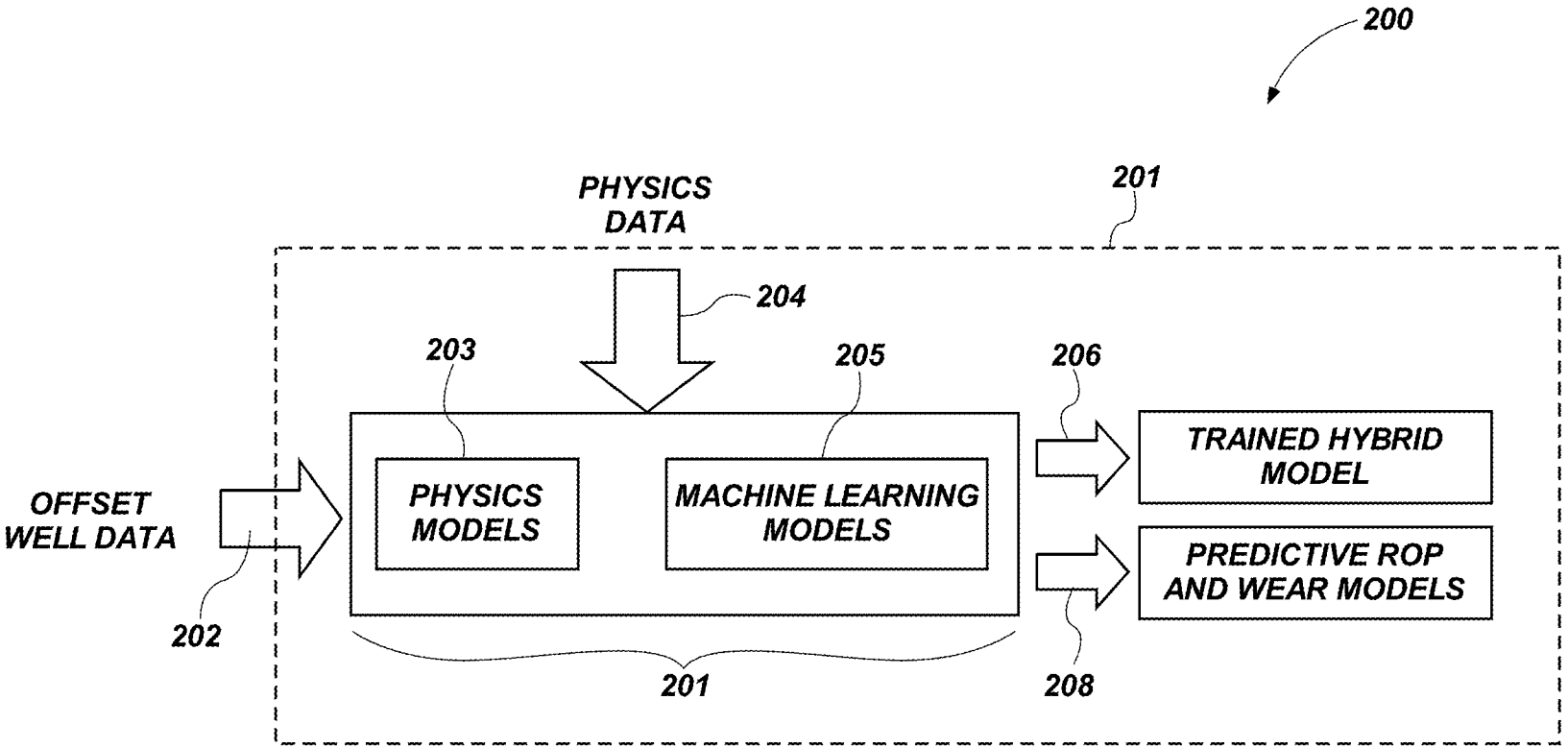
FIG. 2 shows example processes of a prediction system via a schematic-flow diagram according to one or more embodiments of the present disclosure.

FIG. 2 shows example processes 200 of the prediction system 129 via a schematic-flow diagram. For instance, FIG. 2 shows one or more embodiments of a simplified sequence-flow that the prediction system 129 utilizes to train a hybrid model 201 and to provide a predictive ROP and wear model related to earth-boring tools and drilling operations. As used herein, the phrase a "ROP and wear model" may refer to predicted (e.g., estimated) values of rates of penetration and predicted wear states and amounts for a given earth-boring tool during at least a portion of a planned drilling operation or at any point within the planned drilling operation. As will be appreciated by one of ordinary skill in the art, the values indicated in the ROP and wear model may be determined within confidence intervals. Moreover, as described herein, any values determined and/or predicted by the prediction system 129 may be presented within confidence intervals.

In some embodiments, the prediction system 129 may include a hybrid physics and machine-learning model 201 (hereinafter "hybrid model 201"). For example, the hybrid model 201 may include one or more physics models 203 and one or more machine-learning models 205. Furthermore, as is described in greater detail below, the prediction system 129 utilizes the hybrid model 201 to generate one or more ROP and wear predictive models for given earth-boring tools and planned drilling operations.

In some embodiments, the process 200 of generating one or more ROP and wear predictive models for a given earth-boring tool and planned drilling operation may include the hybrid model 201 receiving input data, as shown in act 202 of FIG. 2. In one or more embodiments, the input data may include historical offset well data. For example, the input data may include historical data including one or more of formation logs, well architecture and design data, surface and downhole data, bit and cutter design data, drilling system details data, and bit dull data.

Additionally, the hybrid model 201 receives physics data, as shown in act 204 of FIG. 2. In some embodiments, the physics data may include, for example, one or more force model libraries, rock type behavior repositories, cutter type wear properties, and model parameters and uncertainties. Additionally, the physics data may include three-dimensional geometry descriptions, rock failure models, cutter wear progression models, cutter fracture criteria, and any other phenomena that affect wear and ROP of earth-boring tools. In one or more embodiments, the physics data may include pre-developed physics models that are based on historical data and/or theory and laboratory experimentation.

Upon receiving the offset well data and the physics data, the hybrid model 201 analyzes and processes the input data with the hybrid model 201 (i.e., the one or more physics models 203 and the one or more machine-learning models 205 (i.e., techniques)) to train the hybrid model 201, as will be understood in the art, and to provide predictive ROP and wear models for given earth-boring tools and drilling operations, as shown in acts 206 and 208, respectively. Additionally, via the analysis and the trained hybrid model 201, the hybrid model 201 may provide predictions (e.g., simulations, models, values, etc.) related to drilling parameters such as, (e.g., drilling operations that involve) for example, build-up-rates, turn rates, lateral ROP, unconfined compressive strength, walk rate, dog leg severity, confined compressive strength, contact forces, rib forces, bending moments, WOB, pressures, inclinations, azimuth, borehole trajectories, hole qualities, drilling torque, drilling vibrations, cutter damage (e.g., breakage, chipping, cracking, spalling, etc.), bit trip, gage and bit body wear, etc. In further embodiments, the hybrid model 201 may provide predictions (e.g., simulations, models, values, etc.) related to lithology parameters such as, (e.g., drilling operations that involve) for example, rock types, rock strengths, grain/clast sizes, mineralogy, fabric, chemical properties, compositions, porosity, permeability, and/or texture of a subterranean formation to be drilled. As used herein, the term "drilling parameters" may refer to any of the drilling parameters and lithology parameters described herein. Furthermore, "drilling operations" may refer to any operations that involve (e.g., would be benefited by information related to) any of the above drilling parameter and/or lithology parameters. The training and operations of the hybrid model 201 are described in greater detail below in regard to FIGS. 3A-5.

Figure 3A:
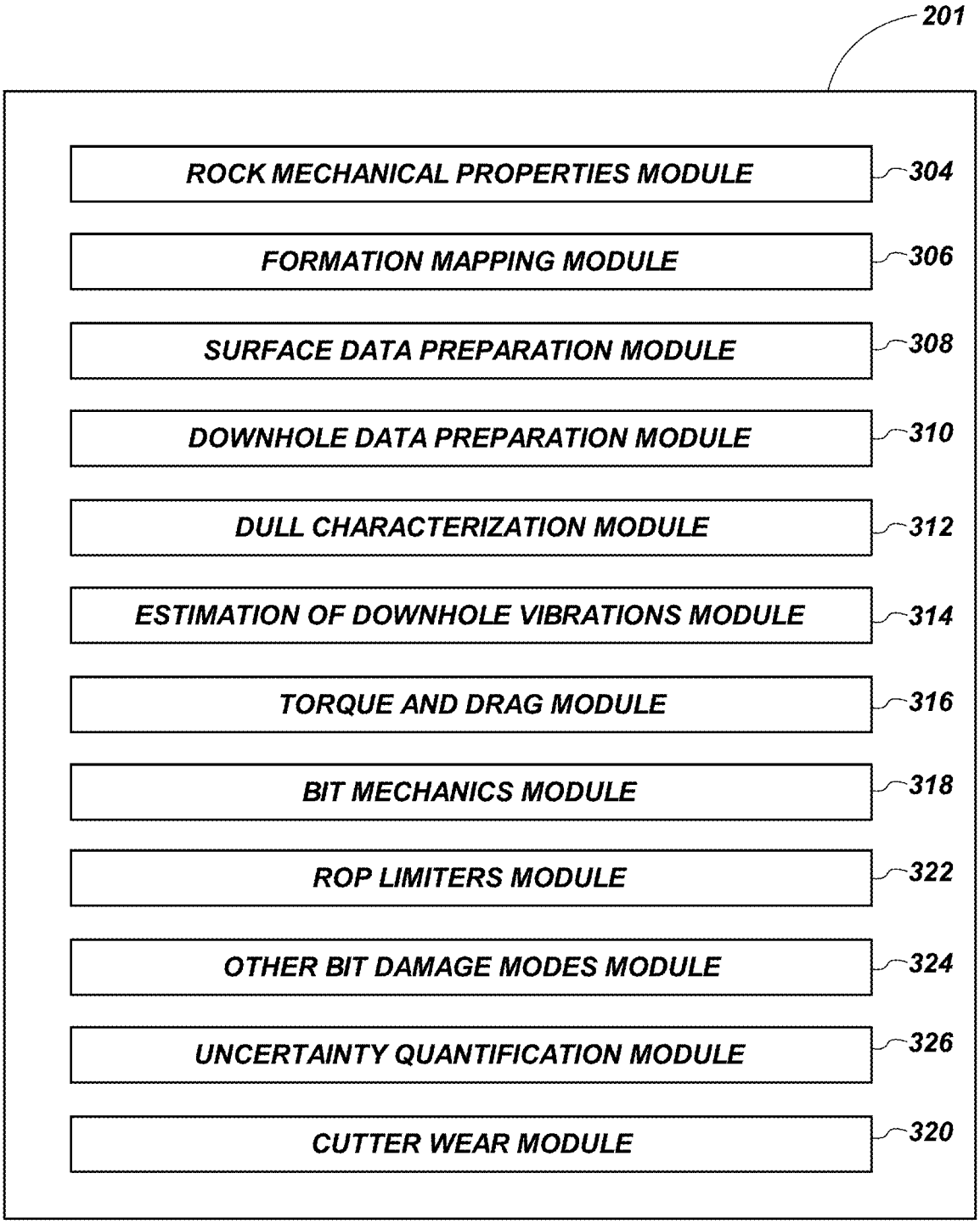
FIG. 3A is a schematic representation of various modules included within a hybrid physics and machine-learning model according to one or more embodiments of the present disclosure.

FIG. 3A is a schematic representation of the hybrid model 201 according to one or more embodiments of the present disclosure. As shown, in some embodiments, the hybrid model 201 may, between the physics models 203 and the machine-learning models 205, include a plurality of modules (e.g., sub-systems and/or models designed to perform particular analyses and operations for the hybrid model 201). In some embodiments, the plurality of modules may form a part of one or more of the physics models 203 and the machine-learning models 205 of the hybrid model 201. For example, a given module may be wholly part of (i.e., operated within) either the physics models 203 or the machine-learning models 205, or the given module may operate within both the physics models 203 and the machine-learning models 205. Additionally, in some embodiments, a given module may be operated within one of the physics models 203 and the machine-learning models 205 but may be dependent on data determined by the other of the physics models 203 and the machine-learning models 205. For example, the given modules may be informed (e.g., taught) by the other of the physics models 203 and the machine-learning models 205, as will be understood in the art. In other embodiments, one or more of the plurality of modules may be separate and distinct from the physics models 203 and/or the machine-learning models 205 of the hybrid model 201, and the physics models 203 and/or the machine-learning models 205 may operate in conjunction with the one or more of the plurality of modules to predict one or more drilling parameters of a drilling operation to assist in generating the predictive ROP and wear model for a given earth-boring tool and a planned drilling operation.

In one or more embodiments, the hybrid model 201 may include a rock mechanical properties module 304, a formation-mapping module 306, surface data preparation module 308, a downhole data preparation module 310, a dull characterization module 312, an estimation of downhole vibrations module 314, a torque and drag module 316, a bit mechanics module 318, a cutter wear module 320, a ROP limiters module 322, an other bit damage modes module 324, and an uncertainty quantification module 326. Each of the foregoing modules is described in greater detail below. Furthermore, as will be appreciated by one of ordinary skill in the art, the hybrid model 201 may include any number of additional modules related to analyzing and processing data for estimating drilling parameters, wear states, lithology parameters, and/or drilling behaviors.

With the rock mechanical properties module 304, the hybrid model 201 may generate predictive models related to component lithology, unified lithology, and rock mechanical properties. For instance, the rock mechanical properties module 304 may utilize the physics models 203 and/or machine-learning models 205 of the hybrid model 201 to generate predictive models related to component lithology, unified lithology, and rock mechanical properties based on formation logs such as gamma ray data, acoustics data, density data, photoelectric absorption data, and neutron porosity data. In some embodiments, the predictive models generated by the rock mechanical properties module 304 provide prediction data related to lithology, properties such as UCS and friction angle, drillability analysis such as abrasivity, interfacial severity, and bit balling index.

Utilizing the formation-mapping module 306, the hybrid model 201 may utilize the physics models 203 and/or machine-learning models 205 of the hybrid model 201 to generate predictive models related to formation properties for a planned well based on offset well formation logs. For instance, the hybrid model 201 may utilize the formation-mapping module 306 to generate predictive models related to formation properties in situations where formation logs are not available for a given formation of a planned drilling operation during model training (discussed below) or during pre-well planning predictions. Additionally, the hybrid model 201 may utilize the formation-mapping module 306 to use seismic measurement data to account for faults in earth formations. Moreover, the hybrid model 201 may utilize the formation-mapping module 306 in real-time (e.g., the real-time hybrid model discussed in greater detail in regard to FIG. 5) to update and correct predicted formation logs based on real-time measured data such as, for example, formation logs or drilling responses.

Using the surface data preparation module 308, the hybrid model 201 may clean surface data of the offset well data of the input data. For instance, the hybrid model 201 may detect and correct (or remove) corrupt or inaccurate records from the surface data and may identify incomplete, incorrect, inaccurate, or irrelevant parts of the surface data and then replace, modify, or delete the coarse data (e.g., dirty data). In some embodiments, the hybrid model 201 may identify missing data or data that is not physically valid and may utilize known in-filling methods to complete missing data where necessary. For example, the hybrid model 201 may clean the surface data in any manner known in the art. Additionally, via the surface data preparation module 308, the hybrid model 201 may prepare the surface data in a format for data analysis by the hybrid model 201. For instance, the hybrid model 201 may prepare the surface data in a format such as, for example, comma separated values (CSV), text, XML, etc. For example, the hybrid model 201 may prepare the surface data in one or more formats that the hybrid model 201 can recognize and read. Moreover, via the surface data preparation module 308, the hybrid model 201 may calculate variances and other statistics such as, for example, means, medians, modes, deviations, moving averages, etc., related to a quality of the surface data.

Via the downhole data preparation module 310, the hybrid model 201 processes available downhole data from the offset well data of the input data and may link the downhole data to time (e.g., time during a drilling procedure represented in the offset well data) and depth references. Additionally, the hybrid model 201 may clean the downhole data. For instance, the hybrid model 201 may detect and correct (or remove) corrupt or inaccurate records from the downhole data and may identify incomplete, incorrect, inaccurate, or irrelevant parts of the downhole data and then may replace, modify, or delete the coarse data (e.g., dirty data). For example, the hybrid model 201 may clean the downhole data in any manner known in the art. Additionally, via the downhole data preparation module 310, the hybrid model 201 may prepare the downhole data in a format for data analysis by the hybrid model 201. Moreover, via the surface data preparation module 308, the hybrid model 201 may calculate variances and other statistics related to a quality of the downhole data.

Utilizing the dull characterization module 312, the hybrid model 201 may process (e.g., analyze) relatively high-resolution (e.g., micron resolutions) scans of bit dulls to characterize amounts of wear on individual cutters, blades, roller cones, or any other portions of an earth-boring tool or drilling assembly and wear scar geometry features for use within wear models. Additionally, via the dull characterization module 312, the hybrid model 201 may process (e.g., analyze) images (e.g., photographs) and/or dull grades to estimate an amount of wear on individual cutters, blades, roller cones, or any other portions of an earth-boring tool or drilling assembly and wear scar geometry features.

Figure 3B:
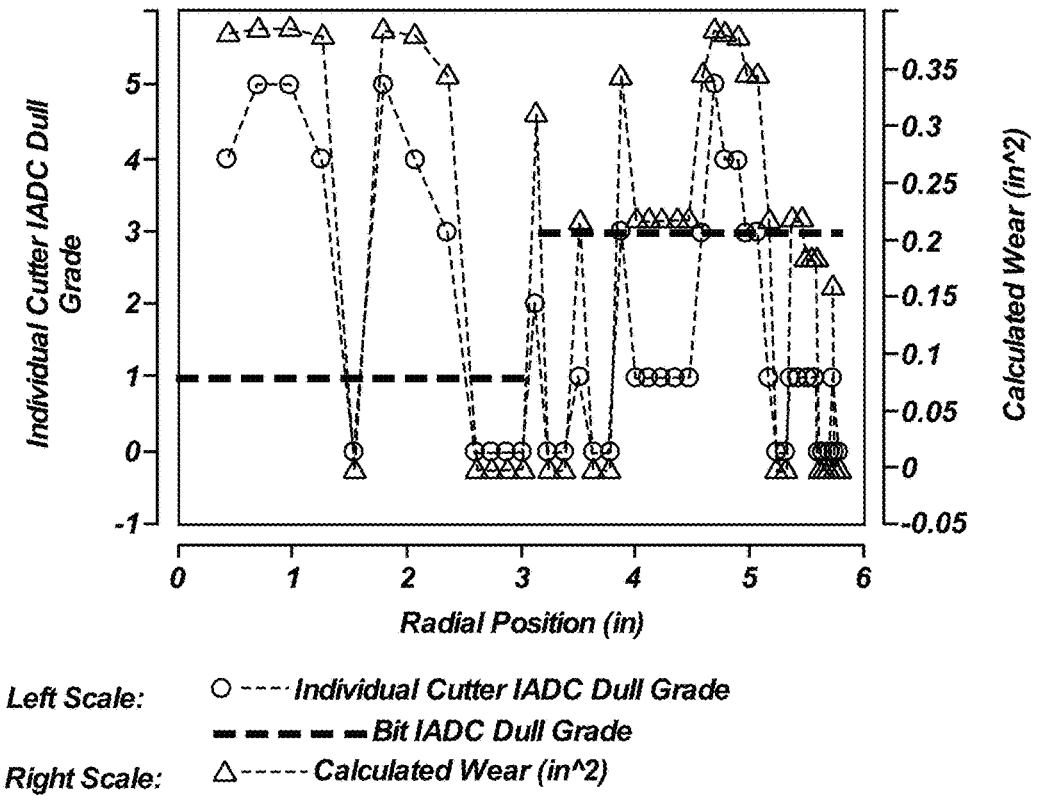
FIG. 3B shows a plot that demonstrates dull state characterization that may be obtained via one or more modules of the hybrid model according to one or more embodiments of the present disclosure.

With continued reference to the dull characterization module 312, FIG. 3B shows a plot that demonstrates dull state characterization that may be determined by cutter level dull grading, laser scans, or high-resolution optical scans of an earth-boring tool (e.g., bit) utilizing the methods (e.g., the dull characterization module 312) described herein. For instance, the plot provides details such as wear area, volume lost, etc., for each cutter of the earth-boring tool. Compared to the conventional bit level International Association of Drilling Contractors (IADC) dull grading, the cutter level dull grading achieved in the present disclosure is more accurate and more detailed. As is apparent from the example below, the bit dull grade for cutters in the inner part of the earth-boring tool determined via the conventional methods has significant error.

With the estimation of downhole vibrations module 314, the hybrid model 201 may, in an absence of downhole measurements, estimate downhole parameters from surface measurements (e.g., surface data). For instance, via the estimation of downhole vibrations module 314, the hybrid model 201 may estimate stick/slip, backward whirl, axial vibrations, etc.

The hybrid model 201 may utilize the torque and drag module 316 to predict (e.g., estimate) axial and torsional friction to be experienced by an earth-boring tool during a planned drill operation. Additionally, the hybrid model 201 may utilize the torque and drag module 316 to predict (e.g., estimate) downhole WOB (or torque) when surface WOB (or torque) measurement are available. For instance, the hybrid model 201 may utilize data, such as, surface data, data related to a well profile, a wellbore quality, adjustable kick off and stabilizers in the bottom-hole-assembly, mud type, flow rates of hydraulic fluids, string rotations per minutes, buckling, and/or vibrations to predict axial and torsional friction to be experienced by an earth-boring tool during a planned drill operation.

In some embodiments, the bit mechanics module 318 may include a numerical model (e.g., a bit mechanics model) that includes a three-dimensional bit design of a given earth-boring tool (e.g., an earth-boring tool to be used in a drilling operation and analyzed during pre-well planning), cutter geometries of the earth-boring tool, detailed dull state characterization, rock properties of a formation, and bottom hole geometry of a well bore. The hybrid model 201 may use the bit mechanics module 318 to determine and/or calculate in-situ rock strength, resulting cutting forces to be experienced on earth-boring tool, and ROP of the earth-boring tool in new and worn states.

Figure 3C:
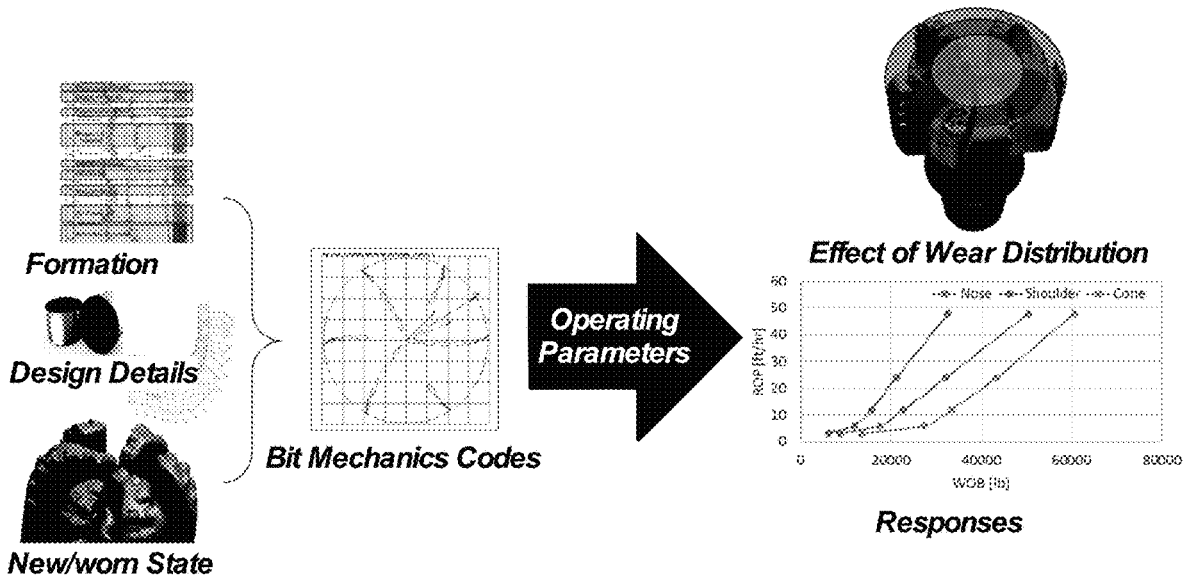
FIG. 3C shows a schematic representation of a process by which a hybrid model may utilize a bit mechanics module to determine and/or calculate in-situ rock strength, resulting cutting forces to be experienced on earth-boring tool, and ROP of the earth-boring tool in new and worn states.

With continued reference to the bit mechanics module 318, FIG. 3C shows a schematic representation of a process by which hybrid model 201 may use the bit mechanics module 318 to determine and/or calculate in-situ rock strength, resulting cutting forces to be experienced on earth-boring tool, and ROP of the earth-boring tool in new and worn states. As shown in FIG. 3C, a same amount of total wear areas distributed on different regions of an earth-boring tool may contribute differently to ROP. For instance, in the example illustrated in FIG. 3C, a cone region of an earth-boring tool is shown to contribute most significantly to ROP, followed by a nose region of the earth-boring tool and the shoulder region of the earth-boring tool.

In one or more embodiments, the cutter wear module 320 may include a numerical model (e.g., a bit wear model) for non-linear wear progression on an earth-boring tool. The numerical model for non-linear wear progression of the cutter wear module 320 may be dependent on the determined cutting forces (e.g., force calculations) from the bit mechanics module 318. Additionally, the cutter wear module 320 may utilize temperature information (e.g., temperature calculations) from a heat transfer model; and the numerical model for non-linear wear progression of the cutter wear module 320 may be dependent on the temperature calculations. The hybrid model 201 may use the cutter wear module 320 to determine and/or calculate non-linear wear on cutters, blades, roller cones, or any other portions of an earth-boring tool during a planned drilling operation.

Figure 3D:
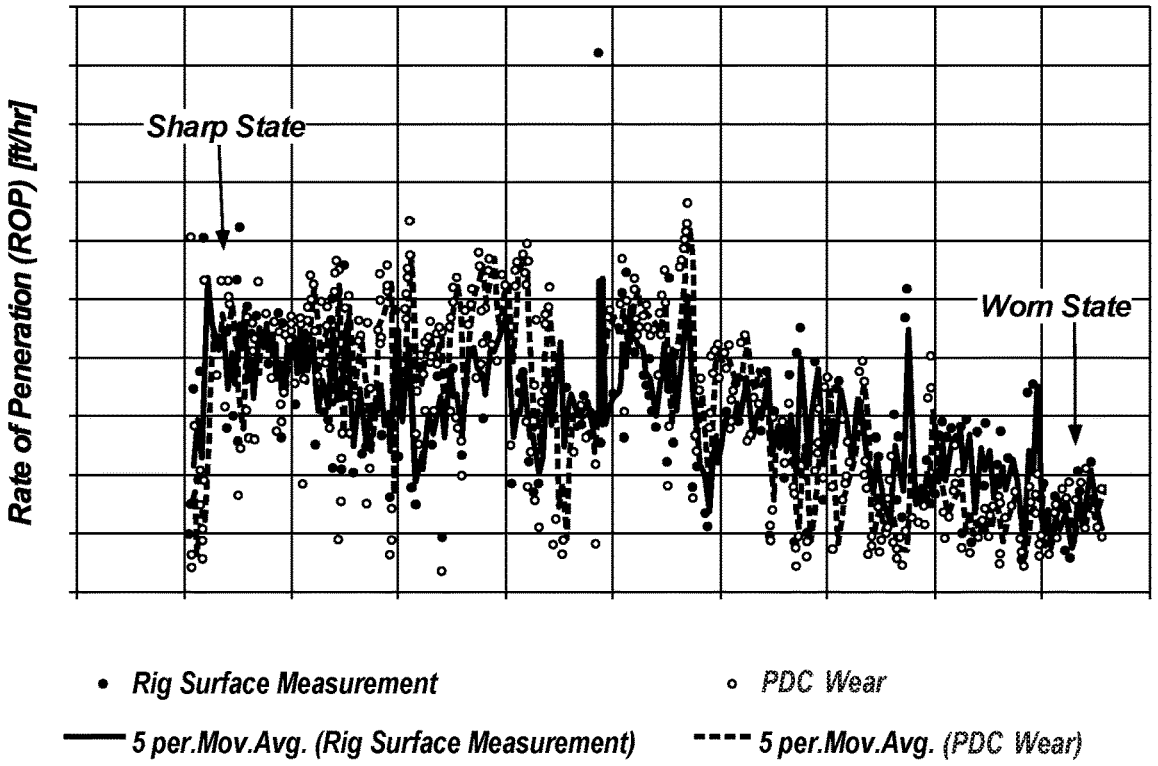
FIGS. 3D and 3E show comparisons of measured and predicted values of ROP and wear according to one or more embodiments of the present disclosure.
Figure 3E:
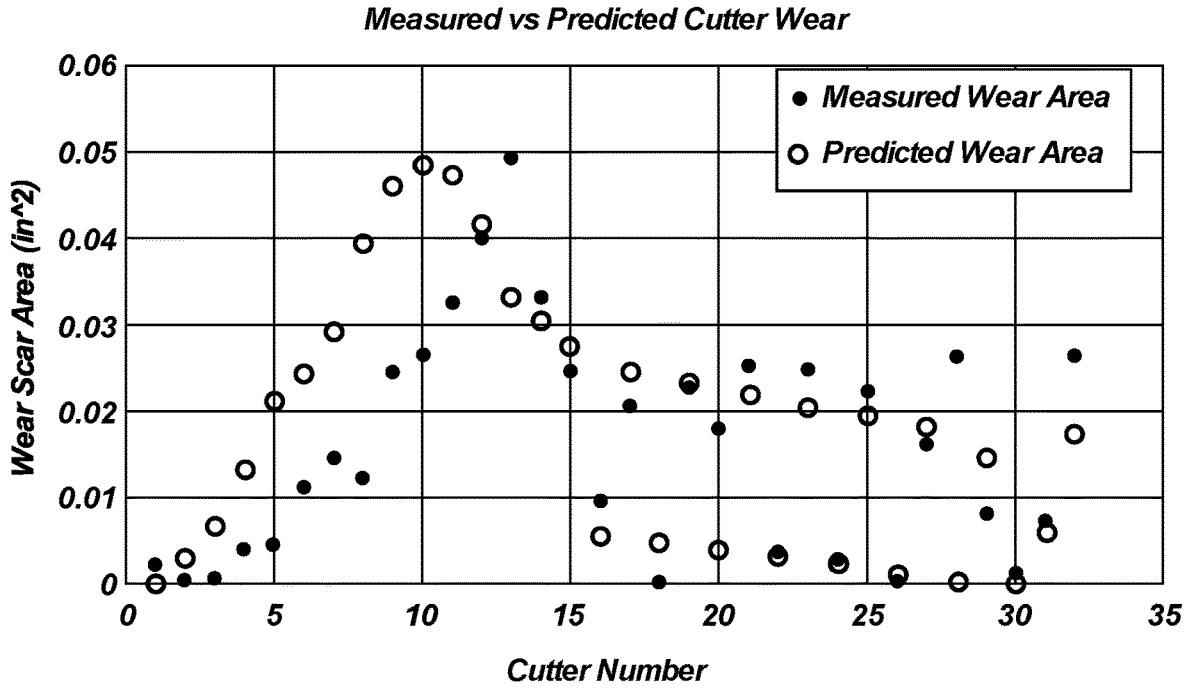

With continued reference to the cutter wear module 320 and the bit mechanics module 318, FIGS. 3D and 3E show comparisons of measured and predicted values of ROP and wear (e.g., earth-boring tool wear). The predicted values are determined with a sub-model of the hybrid model (e.g., the numerical models) in which the physics model of the hybrid model 201 utilizes tuned coefficients (described below in regard to FIG. 4A). The example shown in FIGS. 3D and 3E is representative of a partially trained hybrid model during an iterative training process.

The hybrid model 201 may utilize the ROP limiters module 322 to determine effects of ROP limiters, which are not included in the bit mechanics module 318, on ROP of an earth-boring tool within a formation during a planned drilling operation. For example, the hybrid model 201 may utilize the ROP limiters module 322 to determine effects of mud (e.g., oil-based mud, solids content of mud, mud weights, mud viscosity, etc.), vibrations, rate sensitivity in drilling, bit balling, etc., on ROP of an earth-boring tool during a planned drilling operation.

Using the other bit damage modes module 324, the hybrid model 201 may predict (e.g., estimate) bit damage on an earth-boring tool from sources other than smooth wear. For example, using the other bit damage modes module 324, the hybrid model 201 may predict gross cracking on the earth-boring tool due to overloads from impacts or formation transitions, damage accumulation due to repeated impacts and/or fretting, and fatigue damage due to fluctuating loads. Additionally, via the other bit damage modes module 324, the hybrid model 201 may predict effects of earth-boring tool (e.g., bit) and/or cutter design features on damage to the earth-boring tool that are not accounted for with the bit mechanics module 318 and the cutter wear module 320.

The hybrid model 201 may use the uncertainty quantification module 326 to identify amounts of uncertainty in the predictions and/or generated predictive models of the hybrid model 201. For example, the hybrid model 201 may use the uncertainty quantification module 326 to determine variances of known parameters, error bounds for calculated parameters, and confidence intervals and/or probabilities for a predictions and/or predictive model. Additionally, the hybrid model 201 may use the uncertainty quantification module 326 to identify parameters that are not accounted for in any predictive models generated by the hybrid model 201 and to identify effects that are not accounted for and/or explained by any predictive models generated by the hybrid model 201. Moreover, the hybrid model 201 may use the uncertainty quantification module 326 to perform performance quality checks on input and output data. Likewise, the hybrid model 201 may use the uncertainty quantification module 326 to identify parameters that need to be updated during a real-time application (e.g., updated with real-time data from a real-time drilling operation (discussed in greater detail in regard to FIG. 5)).

Figure 4A:
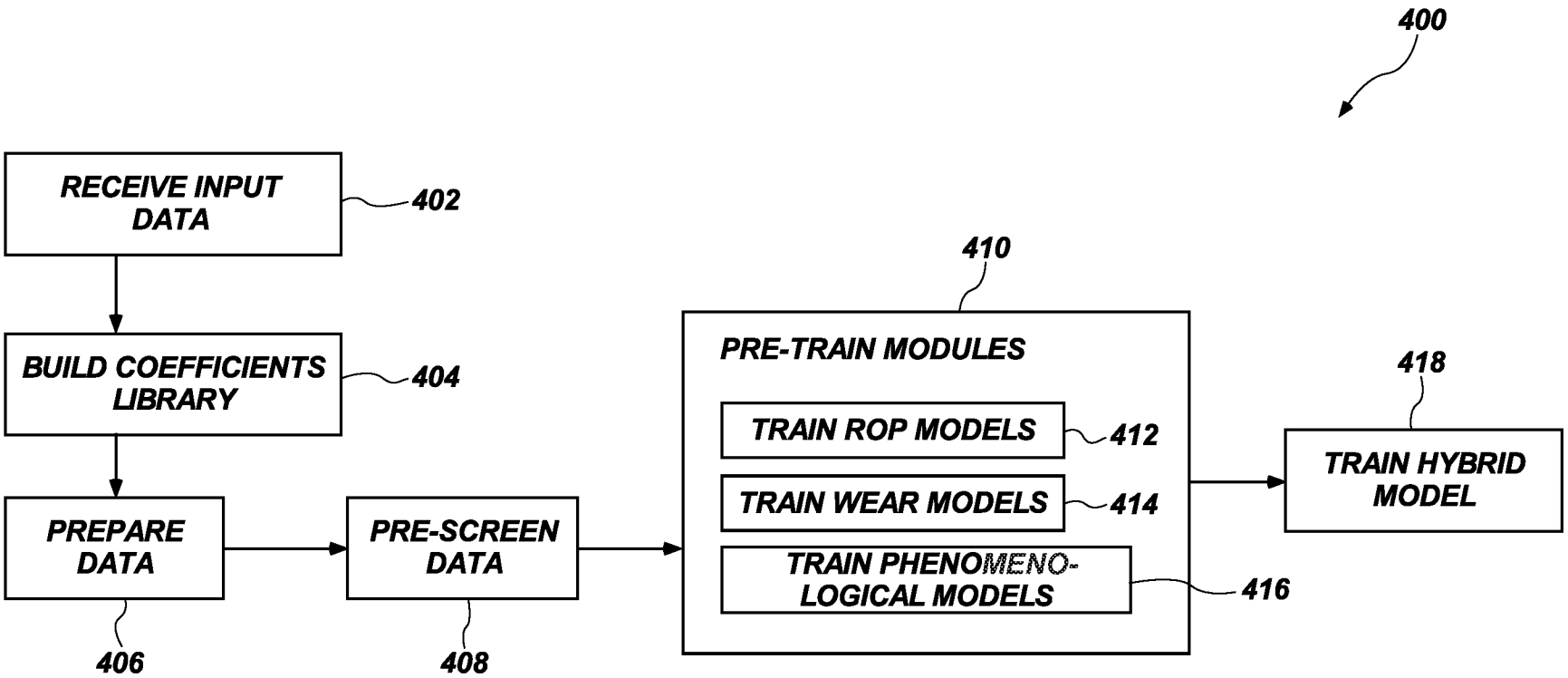
FIG. 4A shows example processes of a prediction system utilized in pre-well planning via a schematic-flow diagram according to one or more embodiments of the present disclosure.
Figure 4B:
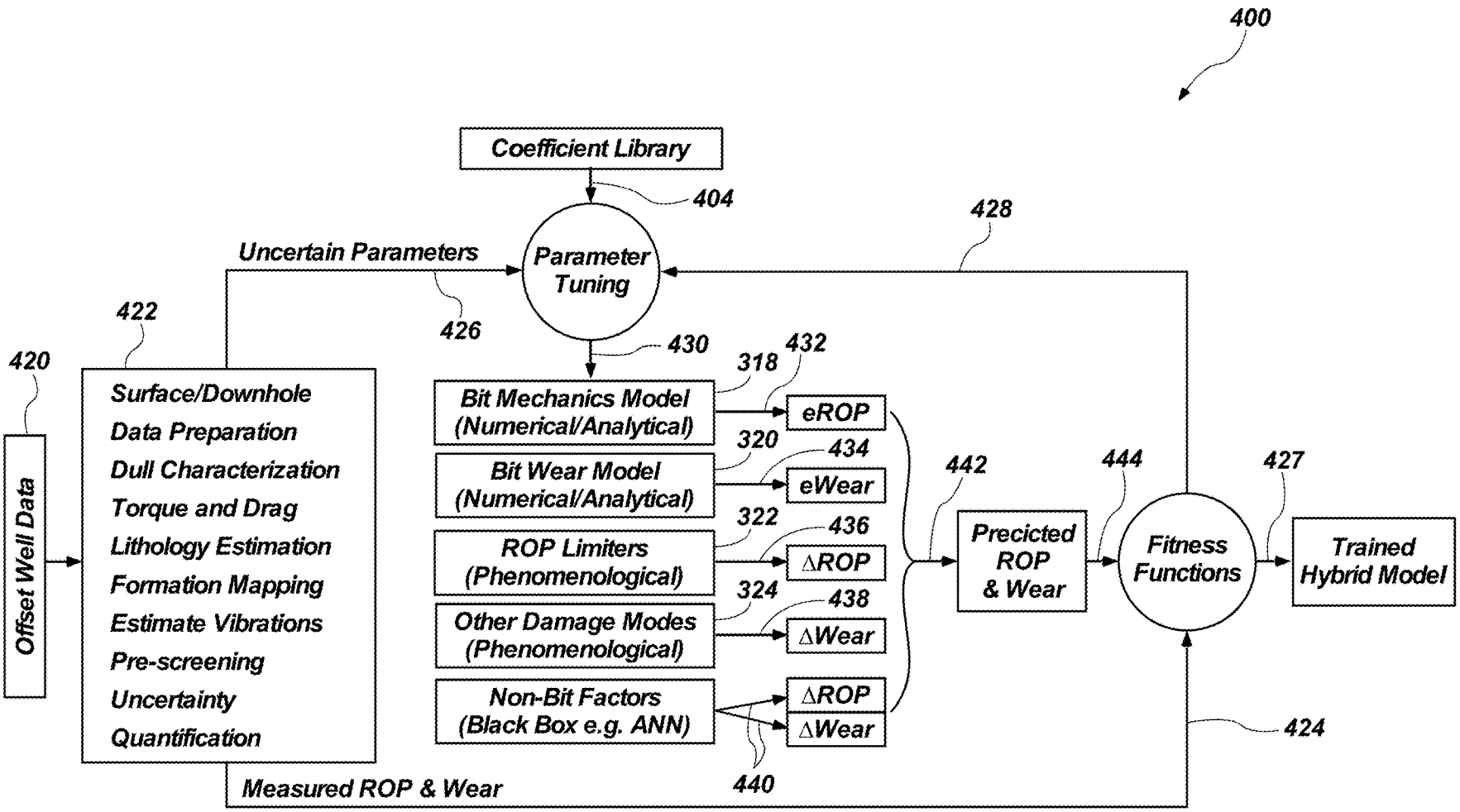
FIG. 4B shows an additional simplified sequence-flow that the prediction system utilizes to train the hybrid model, which is utilized in pre-well planning, according to one or more embodiments of the present disclosure.
Figure 4C:
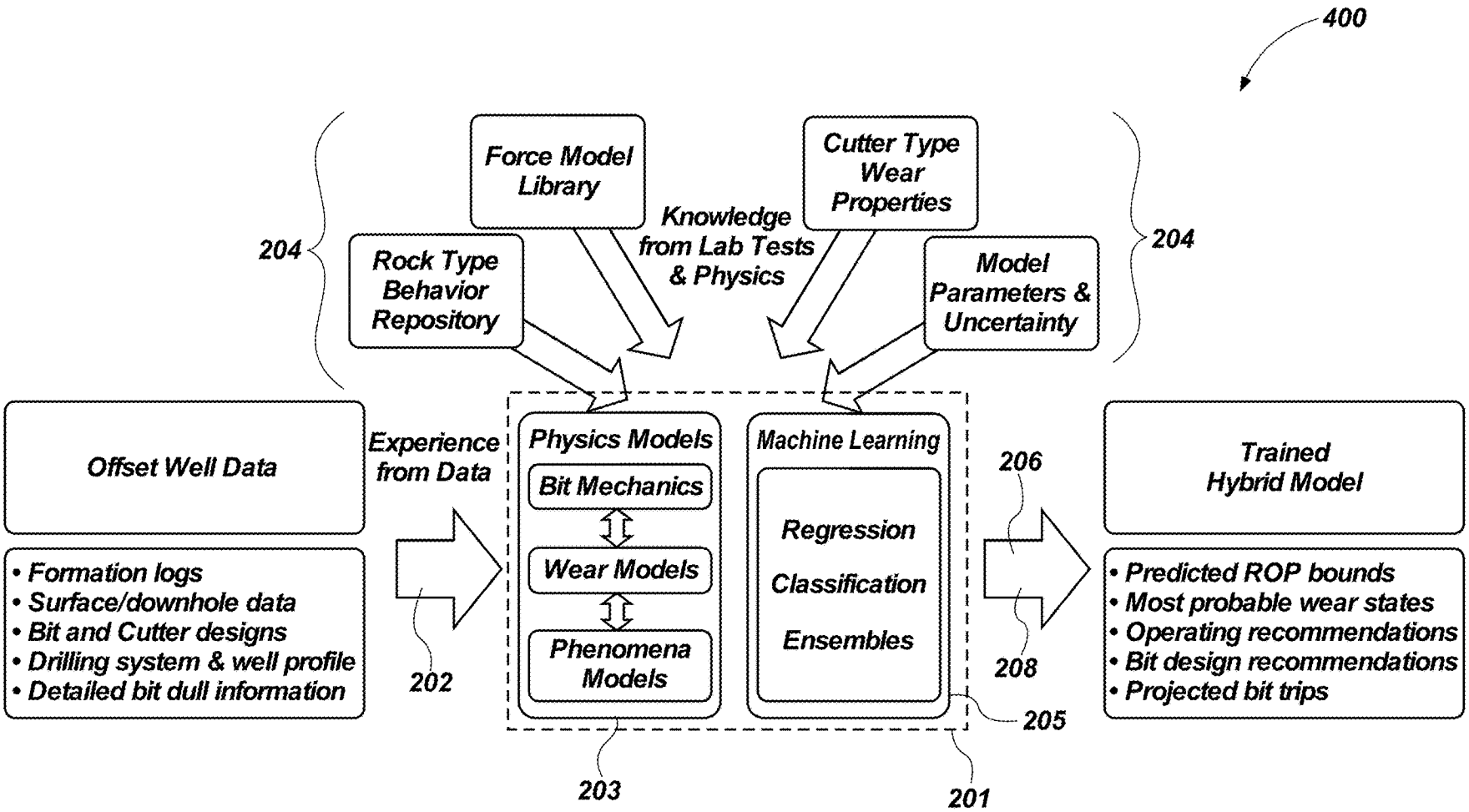
FIG. 4C shows an additional representation of the sequence-flow of FIG. 4A that the prediction system utilizes to train the hybrid model and/or generate one or more rate of penetration and wear predictive models for given earth-boring tools and planned drilling operations during pre-well planning, according to one or more embodiments of the present disclosure.

FIG. 4A shows example processes 400 of the prediction system 129 via a schematic-flow diagram. For instance, FIG. 4A shows one or more embodiments of a simplified sequence-flow that the prediction system 129 utilizes to train the hybrid model 201 and/or generate one or more ROP and wear predictive models for given earth-boring tools and planned drilling operations. FIG. 4B shows an additional simplified sequence-flow that the prediction system 129 utilizes to train the hybrid model 201. FIG. 4C shows another representation of the sequence-flow that the prediction system 129 utilizes to train the hybrid model 201 and/or generate one or more ROP and wear predictive models for given earth-boring tools and planned drilling operations.

Referring to FIGS. 4A, 4B, and 4C together, as shown in act 402 of FIG. 4A, as discussed above, the hybrid model 201 receives input data, as shown in act 402 of FIG. 4A. In some embodiments, the input data may include offset well data and physics data (e.g., data from laboratory tests and physics models 203). As mentioned above, the offset well data may include one or more of formation logs, well architecture and design, surface and downhole data, bit and cutter design information, drilling system details, and bit dull information, while the physics data may include data from rock-type behavior repositories, from force model libraries, related to cutter type wear properties, and from model parameters and uncertainties.

Based on the input data, the hybrid model 201 builds a coefficients library utilized with the models to be predicted and/or generated by the hybrid model 201, as shown in act 404 of FIG. 4A. In some embodiments, the hybrid model 201 builds the coefficients library based primarily on laboratory data and physics (e.g., the physics data). For example, the hybrid model 201 may build the coefficients library in order to account for known information (e.g., parameters determined and known by the physics models 203 and experimentation) within the hybrid model 201 (i.e., model) by constraining behavior of free parameters within the hybrid model 201. In some embodiments, the known information may be acquired from historic laboratory tests, new laboratory tests, internal/external literature on wear tests, drilling tests, cutting tests, rock hardness tests, rock abrasivity tests, etc. Moreover, by and/or while building the coefficients library, the hybrid model 201 determines dependency of the coefficients on cutter types, cutter geometries, cutter materials, rock types, lithology parameters, environments, etc. Furthermore, by and/or while building the coefficients library, the hybrid model 201 determines relative rankings and influences of coefficients for different cutters, rocks, environments, etc., (e.g., drilling parameters) of a planned drilling operation. Likewise, by and/or while building the coefficients library, the hybrid model 201 determines initial predications (e.g., values) and upper and lower bounds for all the determined coefficients of the coefficients library. The hybrid model 201 may utilize any of the plurality of modules described in regard to FIGS. 3A-3E to build the coefficients library.

Below are some examples of determining coefficients of the coefficients library. As will be appreciated by one of ordinary skill in the art, measured responses in field data (e.g., input data) and the hybrid model 201 may be expressed as:

$$Y^F = Y^F(X^C); Y^M = Y^F(X^C, C)$$

where the field responses, $Y^F$ (e.g., ROP, wear state) are dependent on controlled variables, $X^C$ (WOB, RPM, etc.) and the behavior is governed by the field (i.e., natural science and/or physics). The model $Y^M$ aims to capture the same behavior with physical and data influenced laws that contain modeling constants, C ($C_o$, $C_1$, m, $A_1$, $A_2$, . . . ). As will be appreciated by one of ordinary skill in the art, there can be errors involved in measurement and computation that are not accounted for here.

The foregoing algorithm involves decomposing the modeling constants C into rock, bit (e.g., cutting and/or rubbing elements), and environment dependent quantities from laboratory and physics data (e.g., knowledge). The method includes isolating the dependencies where possible but may include combining the dependencies in some situations. For example, some constants could be rock and environment dependent.

The following is a non-limiting example of a wear model: Wear of an elemental strip of height Z is given as:

$$DZ = F(T)ABR\,DL$$

$$F(T) = C_0\mathrm{EXP}\left[\frac{C_1(T+273)}{3273}\right]$$

where DZ is incremental wear, ABR is abrasivity of rock, DL is incremental distance slid, and F(T) is a temperature dependent function of cutter hardness ($C_o$ and $C_1$ are coefficients). The temperature evolution is governed by:

$$\overline{T}_w - T_f = q_1 f = \frac{\alpha K_f F_n V}{A_w} f$$

$$f(WFA, h) = C_1 \times h^{C_2} \times WFA^{C_3} \ldots + C_4 \mathrm{EXP}(-h)$$

where $T_w$ is wear flat temperature, $T_f$ is fluid temperature, $F_n$ is normal force on the wear flat, V is the cutting speed, $A_w$ (or WFA) is an area of wear flat, h is convection heat transfer coefficient, and $C_1$-$C_4$ and $\alpha$ are constants.

Likewise, as another non-limiting example, within a force model, the hybrid model 201 may determine dependencies of coefficients (e.g., worn state coefficients to predict wear flat pressure). For instance, influence of a dependency of a coefficient may be relatively quantified from laboratory tests and physics data (e.g., knowledge). Additionally, the relative influence of dependency may be determined under various conditions (e.g., rock type under various fluid conditions). Furthermore, initial estimates (e.g., guesses) may be provided to the hybrid model when determining the coefficients library. For instance, the hybrid model 201 may develop initial estimates, bounds, relative influence/ranking, dependencies, interactions, and other constraints on behavior of the coefficients (i.e., free parameters) based on laboratory tests, literature, and physics (i.e., physics data). As will be appreciated by one of ordinary skill in the art, developing the initial estimates, bounds, relative influence/ranking, dependencies, interactions, and other constraints on behavior of the coefficients (i.e., free parameters) based on physics data enhances prediction accuracy and reduces required amounts of offset well data for training the hybrid model 201.

Upon determining and/or building the coefficients library, the hybrid model 201 prepares the input data for data analysis by the hybrid model 201, as shown in act 406 of FIG. 4A. For instance, the hybrid model 201 may clean all available surface data and downhole data from the offset well data of the input data. As a non-limiting example, the hybrid model 201 may detect and correct (or remove) corrupt or inaccurate records from the surface data and downhole data and may identify incomplete, incorrect, inaccurate, or irrelevant parts of the surface data and downhole data and then replace, modify, or delete the coarse data (e.g., dirty data). For example, the hybrid model 201 may clean the surface data and downhole data in any manner known in the art. Additionally, the hybrid model 201 may prepare the surface data and downhole data in a format for data analysis by the hybrid model 201. Moreover, the hybrid model 201 may calculate variances and other statistics related to a quality of the surface data and downhole data. In some embodiments, the hybrid model 201 may use one or more of the surface data preparation module 308 and the downhole data preparation module to prepare the surface data and the downhole data.

Additionally, preparing the input data for data analysis by the hybrid model 201 may include characterizing dull states of an earth-boring tool and/or portions of an earth-boring tool. For example, the hybrid model 201 may process (e.g., analyze) relatively high-resolution scans of bit dulls to characterize amounts of wear on individual cutters, blades, roller cones, etc., and wear scar geometry features. Additionally, the hybrid model 201 may process (e.g., analyze) images (e.g., photographs) and/or dull grades to estimate an amount of wear on individual cutters, blades, roller cones, or any other portions of an earth-boring tool and wear scar geometry features. For instance, the hybrid model 201 may use the dull characterization module 312 to characterize the dull states of an earth-boring tool and/or portions of an earth-boring tool.

Moreover, preparing the input data for data analysis by the hybrid model 201 may include predicting (e.g., estimating) rock mechanical properties. For example, the hybrid model 201 may generate predictive models related to component lithology, unified lithology, and rock mechanical properties. For instance, hybrid model 201 may generate predictive models related to component lithology, unified lithology, and rock mechanical properties based on formation logs such as gamma ray data, acoustics data, density data, photoelectric absorption data, and neutron porosity data. In some embodiments, the hybrid model 201 may use the rock mechanical properties module 304 to predict rock mechanical properties. Additionally, the hybrid model 201 may use the formation-mapping module 306 to map a current well and/or well plan. Moreover, the hybrid model 201 may use the estimation of downhole vibrations module 314 to estimate downhole vibrations. As will be understood in the art, all of or portions of the above-determine predicted values and predictive models may be added to the input data for further analysis by the hybrid model 201.

After preparing the input data for data analysis, the hybrid model 201 pre-screens the prepared input data, as shown in act 408 of FIG. 4A. In some embodiments, pre-screening the prepared input data may include performing high-level analytics to identify major effects and factors that affect ROP and damage/wear of earth-boring tools and/or drilling assemblies. In some embodiments, the high-level analytics may include high-level descriptive, predictive, diagnostic, and prescriptive analytics, which are known in the art. As a non-limiting example, pre-screening the prepared input data may include determining which non-earth-boring tool (e.g., non-bit) related factors are affecting ROP and damage/wear of earth-boring tools. For instance, pre-screening the prepared input data may relate to operating practices and may include determining how well recommended procedures are followed by an operator or an automatic drilling. Additionally, pre-screening the prepared input data may include determining a quality of making drill pipe connections (e.g., duration, damage to threads), a quality of restarting drilling operations after a connection, etc. As another non-limiting example, pre-screening the prepared input data may include determining whether earth-boring tool effects (e.g., bit effects) are affecting ROP and damage/wear of the earth-boring tool. As yet another non-limiting example, pre-screening the prepared input data may include determining whether wear is a dominant damage mode.

Upon pre-screening the prepared input data, the hybrid model 201 pre-trains the individual modules of the hybrid model 201, as shown in act 410 of FIG. 4A. In some embodiments, pre-training the individual modules may include training a hybrid bit mechanics module 318 (e.g., ROP model), as shown in act 412 of FIG. 4A. In one or more embodiments, the hybrid model 201 trains the hybrid bit mechanics module 318 with the offset field data. Additionally, the hybrid model 201 trains the bit mechanics module 318 by predicting the ROP of a given earth-boring tool within a planned drilling operation at the beginning of the drilling operation (e.g., run) in a sharp state using a design and/or bit metrology pre-drilling operation (e.g., pre-run), and the hybrid model 201 trains the hybrid bit mechanics module 318 by predicting the ROP at an end of the drilling operation in a worn state using metrology of a dull bit (e.g., earth-boring tool). By predicting the ROP at the beginning of a drilling operation and at the end of the drilling operation, the hybrid model 201 predicts sharp state force model coefficients and at least some worn state force model coefficients. As will be understood by one of ordinary skill in the art, multiple solutions may be possible.

In one or more embodiments, pre-training the individual modules may include training the hybrid bit mechanics module 318 and the cutter wear module 320 (e.g., wear models) of the physics models 203 of the hybrid model 201, as shown in act 414 of FIG. 4A. In some embodiments, the hybrid model 201 trains the bit mechanics module 318 and cutter wear module 320 by predicting wear states of an earth-boring tool and the ROP of the earth-boring tool during an end of a drilling operation (e.g., run). The hybrid model 201 may compare a predicted dull to final field (e.g., real) dull metrology data. The foregoing may demonstrate the effects of formation abrasiveness, cutter wear resistance, and bit design/cutter redundancy. Additionally, based on the foregoing, the hybrid model 201 may predict coefficients for a worn state force model and a wear progression model. As will be understood by one of ordinary skill in the art, multiple solutions may be possible.

In some embodiments, pre-training the individual modules may include optionally training phenomenological models for ROP and wear of the physics models 203, as shown in act 416. The phenomenological models may include measured responses (e.g., mechanical specific energy and/or ROP) and wear progression (e.g., Archard's Model). Additionally, the phenomenological models may be earth-boring tool company diagnostic and may be utilized in an ensemble (e.g., combination of machine-learning models 205 (i.e., techniques)). Beyond what is described herein, any of the modules and/or models described herein may be trained via any of the methods described in U.S. Pat. No. 8,417,495 to Dashevskiy, the disclosure of which is incorporated in its entirety be reference herein.

In some embodiments, pre-training the individual modules may include predicting (e.g., estimating) the contributions of effects that not included in the bit mechanics and wear models (e.g., bit mechanics module 318, cutter wear module 320, etc.). For instance, pre-training the individual modules may include predicting the contributions of the ROP limiters module 322, other bit damage modes module 324, and other factors, such as, for example, rig parameters (e.g., type, drilling parameters, and bottom-hole-assembly parameters). The foregoing modules may account for incremental effects in ROP and wear/damage on the earth-boring tool.

Upon training the individual modules, the hybrid model 201 may train the hybrid model 201, as shown in act 418 of FIG. 4A. FIG. 4B shows a schematic diagram representing an example of how the hybrid model 201 is trained and how the physics models 203 and the machine-learning models 205 within the hybrid model 201 interact. For example, as show in FIG. 4B, and as discussed above, the hybrid model 201 may receive input data, as show in act 420 of FIG. 4B. Additionally, the input data may include any of the input data described above in regard to FIGS. 2-4A. Furthermore, as shown in act 422, the hybrid model 201 may analyze the input data with the machine-learning models 205 of the hybrid model 201 and within a plurality of the modules described above in regard to FIGS. 3A-3E. For example, the hybrid model 201 may analyze the input data via one or more of the surface data preparation module 308, the downhole data preparation module 310, the dull characterization module 312, the estimation of downhole vibrations module 314, the torque and drag module 316, the rock mechanical properties (i.e., lithology estimation) module 304, the formation-mapping module 306, and the uncertainty quantification module 326. Additionally, the hybrid model 201 may analyze the input via any of the methods described above in regard to FIG. 2 and in regard to the above-listed modules.

As noted above, the hybrid model 201 may analyze the input data utilizing the machine-learning models 205 of the hybrid model 201. For instance, the hybrid model 201 may analyze the input data utilizing one or more of regression models (e.g., a set of statistical processes for estimating the relationships among variables), classification models, and/or phenomena models. Additionally, the machine-learning models 205 may include a quadratic regression analysis, a logistic regression analysis, a support vector machine, a Gaussian process regression, ensemble models, or any other regression analysis. Furthermore, in yet further embodiments, the machine-learning models 205 may include decision tree learning, regression trees, boosted trees, gradient boosted tree, multilayer perceptron, one-vs-rest, Naïve Bayes, k-nearest neighbor, association rule learning, a neural network, deep learning, pattern recognition, or any other type of machine-learning. In yet further embodiments, the analysis may include a multivariate interpolation analysis.

In some embodiments, the hybrid model 201 may also perform the pre-screening analysis described above in regard to act 408 of FIG. 4A on the input data.

Upon analyzing the input data via the above-described modules and machine-learning models 205, the hybrid model 201 processes any data related to measured and/or determined drilling parameters (e.g., ROP and wear parameters) with fitness functions, as shown in act 424 of FIG. 4B and processes uncertain parameters, described above in regard to uncertainty quantification module 326 and FIG. 3A, via a parameter tuning process, as shown in act 426 of FIG. 4B.

Processing the data related to measured and/or determined drilling parameters (e.g., ROP and wear parameters) with fitness functions (e.g., error or objective functions) may include applying one or more fitness functions to the data to prediction errors in (i.e., differences between) reference solutions (e.g., measured values of parameters being predicted) and model predicted values. For example, applying one or more fitness functions to the data quantifies how well the hybrid model 201 is able to predict reality. In other words, the fitness functions determine prediction error (i.e., the difference between measured values and model predicted values). In some embodiments, the fitness functions may compare error at each depth or time increment (pointwise) of a drilling operation, compare smoothened (e.g., moving average filter) values, compare shapes of the measured and predicted curves (e.g., correlation functions), and/or use statistical measures such as k-test to determine error. Error may be calculated as an average, a mean square error, an average correlation coefficient, a performance index, a least squared error, etc.

The data related to measured and/or determined drilling parameters (referred to herein as "measured data") may also be utilized to at least partially train the hybrid model 201, as shown in act 427 of FIG. 4B. In other words, for a given set of input values (e.g., parameters), the hybrid model 201 is expected (e.g., trained) to produce the same output values (e.g., measured and/or determined drilling parameters). For example, the hybrid model 201 may be trained via any of the methods described in U.S. Pat. No. 8,417,495 to Dashevskiy, the disclosure of which is incorporated in its entirety be reference herein.

In some embodiments, in addition to training the hybrid model 201 at least partially with the measured data, as noted above, the hybrid model 201 may identify parameters in the measured data (e.g., offset well data, etc.), which are not known with enough certainty and subjects the identified parameters to a parameter tuning process, as shown in act 428 of FIG. 4B and as mentioned above in regard to act 426 of FIG. 4B. For example, if the error determined via the fitness functions is greater than a tolerance (or improvement in the error in successive iterations is greater than a tolerance), the hybrid model 201 utilizes an algorithm to adjust (e.g., tune) the coefficients in the hybrid model 201 within the constraints identified by the coefficient library and modules described above. For example, for parameters within the data for which values are not known with relatively high level of certainty (i.e., for parameters with errors greater than a given tolerance), the hybrid model 201 may subject the data to parameter tuning process. In other words, the hybrid model 201 may identify parameters having the greatest uncertainty and may subject only those identified parameters to the parameter tuning process. Having a smaller number of free parameters alleviates problems with overfitting and improves accuracy. Acts 424, 426, and 428 of FIG. 4B result in one or more sets of tuned coefficient values for the coefficients library of the trained hybrid model 201.

Upon tuning the coefficient library, the uncertain parameters, and the measured data via the parameter tuning process, the hybrid model 201 provides the tuned data (e.g., tuned coefficient values) to one or more of the modules within the physics models 203 and the machine-learning models 205 of the hybrid model 201, as shown in act 430 of FIG. 4B. In particular, the hybrid model 201 provides the tuned data (e.g., tuned coefficient values) to the bit mechanics module 318, the cutter wear module 320, the ROP limiters module 322, of the other bit damage modes module 324 of the physics models 203. Additionally, the hybrid model 201 provides the tuned data (e.g., tuned coefficient values) to one or more black-box machine-learning models and/or neural networks for an analysis of non-earth-boring tool factors (i.e., non-bit factors).

The bit mechanics module 318 may utilize the tuned data (e.g., tuned coefficient values) via any of the manners described above in regard to FIGS. 3A-3E to make predictions. For instance, the hybrid model 201 may use the bit mechanics module 318 and the tuned data to determine and/or calculate in-situ rock strength, resulting cutting forces on earth-boring tool, and ROP in new and worn states of the earth-boring tool. As a non-limiting example, the hybrid model 201 may use the bit mechanics module 318 to predict (e.g., estimate) an ROP in new and worn states of the earth-boring tool, as shown in act 432 of FIG. 4B.

The cutter wear module 320 (referred to as "bit wear model") may utilize the tuned data (e.g., tuned coefficient values) via any of the manners described above in regard to FIGS. 3A-3E to make predictions. For example, the hybrid model 201 may use the cutter wear module 320 and the tuned data to predict (e.g., estimate) non-linear wear on cutters, blades, roller cones, or any other portion of an earth-boring tool during a planned drilling operation, as shown in act 434 of FIG. 4B.

The ROP limiters module 322 may analyze utilize the tuned data (e.g., tuned coefficient values) via any of the manners described above in regard to FIGS. 3A-3E to make predictions. For instance, the hybrid model 201 may use the ROP limiters module 322 and the tuned data to predict (e.g., estimate) the effects of ROP limiters on the ROP of an earth-boring tool during a planned drilling operation. As a non-limiting example, the hybrid model 201 may use the ROP limiters module 322 to predict a change in ROP of the earth-boring tool due to the ROP limiters during a planned drilling operation, as shown in act 436 of FIG. 4B.

The other bit damage modes module 324 may utilize the tuned data (e.g., tuned coefficient values) via any of the manners described above in regard to FIGS. 3A-3E to make predictions. For example, the hybrid model 201 may use the other bit damage modes module 324 and the tuned data to predict (e.g., estimate) earth-boring tool (e.g., bit) damage from sources other than smooth wear. As a non-limiting example, the hybrid model 201 may use the other bit damage modes module 324 to predict a change in wear (e.g., a change in wear states) of an earth-boring tool during a planned drilling operation or during portions of a planned drilling operation, as shown in act 438 of FIG. 4B.

Additionally, the hybrid model 201 may analyze and/or utilize the tuned data with one or more black-box machine-learning models and/or neural networks to predict changes in ROP and changes in wear due to the influence of unaccounted factors, as shown in act 440 of FIG. 4B. For example, the hybrid model 201 may analyze the tuned data with one or more black-box machine-learning models and/or neural networks to predict changes in ROP and changes in wear due to measured parameters such as bottom-hole assemblies, wellbore profile, vibrations, drilling crew, and rig, as well as unmeasured parameters such as wellbore quality. In view of the foregoing, because portions of the tuned data may have been analyzed via one or more machine-learning techniques as described above in regard to act 422 prior to being analyzed by the physics model 203, the machine-learning models 205 of the hybrid model 201 may inform (e.g., teach) the physics models 203 of hybrid model 201 about reality (i.e., based on real measured input data). Likewise, because portions of the input data originate from physics models, the physics models 203 of the hybrid model 201 inform (e.g., teach) the machine-learning models 205 about physics.

Based on the predicted values of ROP and wear of an earth-boring tool determined in acts 432-440, the hybrid model 201 may predict and generate overall ROP and wear models (the predictive ROP and wear models) for an earth-boring tool during a drilling operation, as shown in act 442 of FIG. 4B. Additionally, in some embodiments, the hybrid model 201 may process the predictive ROP and wear models via one or more fitness functions, as shown in act 444 of FIG. 4B. For instance, the hybrid model 201 may process the predictive ROP and wear models via any of the fitness functions described above and via any of the manners described above in regard to act 424 of FIG. 4B.

Furthermore, the output values of the predictive ROP and wear models (e.g., the values output after applying the fitness functions) may be utilized to train the hybrid model 201 (i.e., hybrid model 201) for a given earth-boring tool and/or planned drilling operation (e.g., planned well). For example, as will be understood in the art, for a given set of input values (e.g., parameters) of an earth-boring tool and/or planned drilling operation, the hybrid model 201 (i.e., hybrid model 201) is expected to produce the same output values (i.e., predictive ROP and wear models) as is produced via the machine-learning models 205 and physics models 203 described in acts 422-444 of FIG. 4B. In particular, the hybrid model 201 is trained to produce the values for a given set of input values (e.g., parameters) of an earth-boring tool and/or planned drilling operation that correspond to the values provided by the machine-learning models 205 and physics models 203 described in acts 422-444 of FIG. 4B by iterating the training process for a large number of input value sets. After a sufficient number of iterations, the hybrid model 201 becomes a trained hybrid model 201. The trained hybrid model 201 may then be utilized to simulate or predict (e.g., estimate) ROP and wear models for a given set of input values (e.g., parameters) of an earth-boring tool and/or planned drilling operation. Furthermore, the hybrid model 201 may then be utilized to determine variance between the ROP and wear models generated by the machine-learning models 205 and physics models 203 described in acts 422-444 of FIG. 4B and the ROP and wear models generated by trained hybrid model 201. As will be understood in the art, the trained hybrid model 201 may include a "pre-well" trained hybrid model 201 at this point, because the trained hybrid model 201 has not been trained on real-time data.

Figure 5:
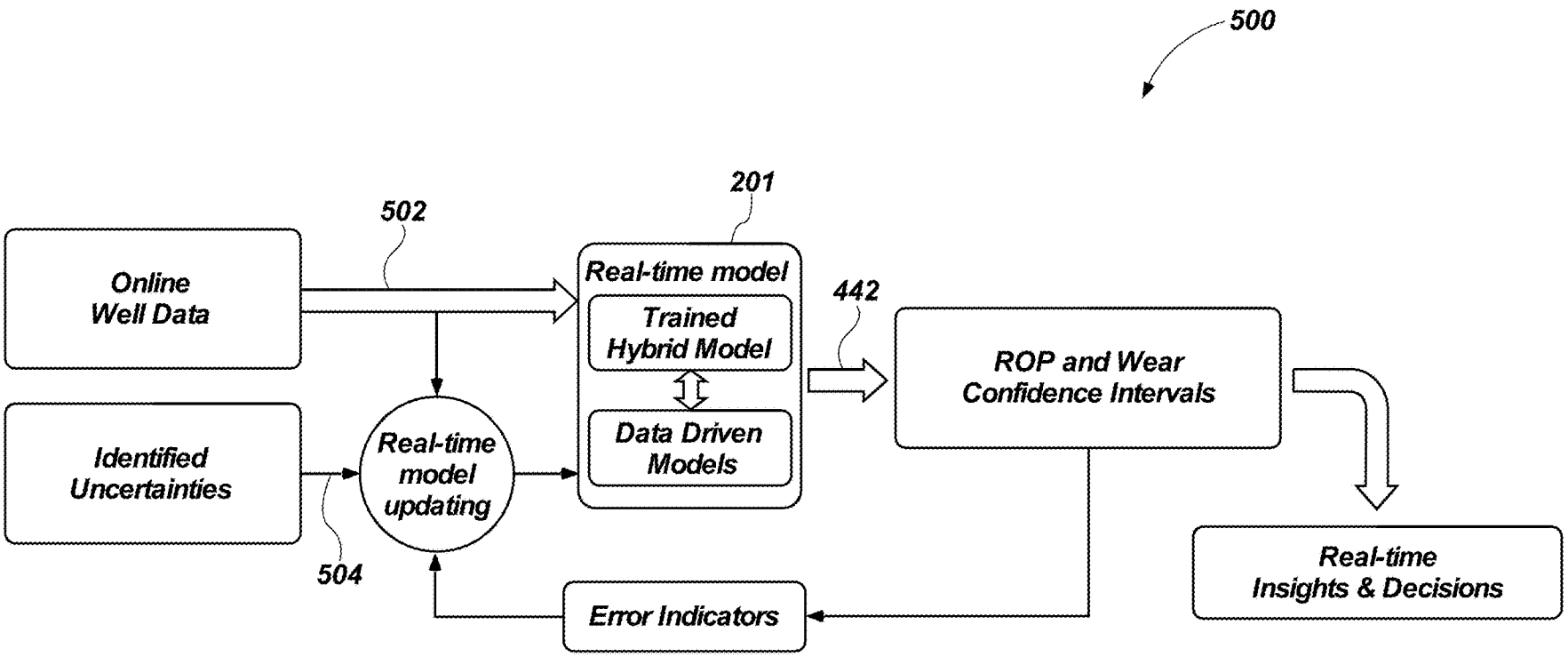
FIG. 5 shows additional example processes of the prediction system including real-time re-training and usage of the hybrid model via a schematic-flow diagram.

FIG. 5 shows additional example processes 500 of the prediction system 129 via a schematic-flow diagram. For instance, FIG. 5 shows one or more embodiments of a simplified sequence-flow that the prediction system 129 utilizes to validate and retrain the hybrid model 201 based on real-time data and provide real-time predictive ROP and wear models. As shown in act 502 of FIG. 5, the hybrid model 201 may receive online well data (i.e., real-time well data) related to a current wellbore operation (e.g., drilling operation). As used herein, the term "real-time" when used in reference to data and/or predictive models may refer data and/or predictive models that are available and/or generated within seconds, minutes, or hours of the events indicated in the real-time data occurring. In one or more embodiments, the real-time well data may be obtained via one or more sensors (e.g., sensors 140 (FIG. 1)) throughout the drilling assembly 114 (FIG. 1). For example, in some embodiments, the real-time data may be obtained via any of the sensors and/or manners described in U.S. Pat. No. 8,100,196, to Pastusek et al., filed Feb. 6, 2009, U.S. Pat. No. 7,849,934, to Pastusek et al., filed Feb. 16, 2007, and U.S. Pat. No. 7,604,072, to Pastusek et al., filed Jun. 7, 2005, the disclosures of which are incorporated in their entireties by this reference herein.

Additionally, the hybrid model 201 may receive uncertain parameters and identify new uncertain parameters based on what real-time (e.g., online) well data is available and the well data's quality, as shown in act 504. For example, the hybrid model 201 may receive any of the uncertain parameters described above in regard to act 426 of FIG. 4B. Moreover, the hybrid model 201 may analyze the online well data and the uncertain parameters via any of the manners described above in regard to FIG. 4B. Furthermore, the hybrid model 201 may retrain (e.g., validate) the hybrid model 201 via any of the training methods described above in regard to FIG. 4B in order to generate a real-time hybrid model 201 (e.g., retrained hybrid model 201, updated hybrid model 201) based on the pre-well hybrid model 201 and the acquired real-time data. In other words, utilizing the online well data, the hybrid model 201 may enhance the pre-well hybrid model 201. As a result, the real-time hybrid model 201 may generate (e.g., determine) real-time predictive ROP and wear models for a given earth-boring tool and drilling operation. Moreover, as will be understood, the real-time hybrid model 201 may be continuously refined and updated by continually feeding the real-time hybrid model 201 real-time data and retraining the hybrid model 201.

Based on the real-time predictive ROP and wear models generated by the hybrid model 201, the hybrid model 201 may provide recommendations for drilling parameters, which may lead to real-time drilling parameters optimization. Additionally, based on the real-time predictive ROP and wear models generated by the hybrid model 201, the hybrid model 201 determine and provide an expected earth-boring tool life, most probable wear states, predicted ROP bounds, optimized trip plans, optimized trajectories, etc. Additionally, more accurate predictive ROP and wear models will result in better earth-boring tool and drilling parameters selections, which will result in higher quality boreholes and better success rates of achieving well plans. Moreover, better earth-boring tool and drilling parameters may maximize ROP and optimize directional objectives during a drilling operation.

Furthermore, as will be understood by one of ordinary skill in the art, the prediction system 129 described herein may be advantageous over conventional methods of predicting earth-boring tool operations. For example, the prediction system 129 of the present disclosure may provide a relatively fast and accurate predictive model that requires minimal offset well data. Additionally, the prediction system 129 of the present disclosure may be capable of accounting for introductions of new input variables and/or conditions as well as uncertainties.

Moreover, information provided via the real-time predictive ROP and wear models may be utilized to optimize PDC bit design and drilling parameters of an earth-boring tool for performance in a dull state and to extend ROP in a dull state. As a result, the prediction system 129 of the present disclosure may reduce invisible lost time and non-productive time, which may lead to cost savings and more efficient drilling operations.

Figure 6:
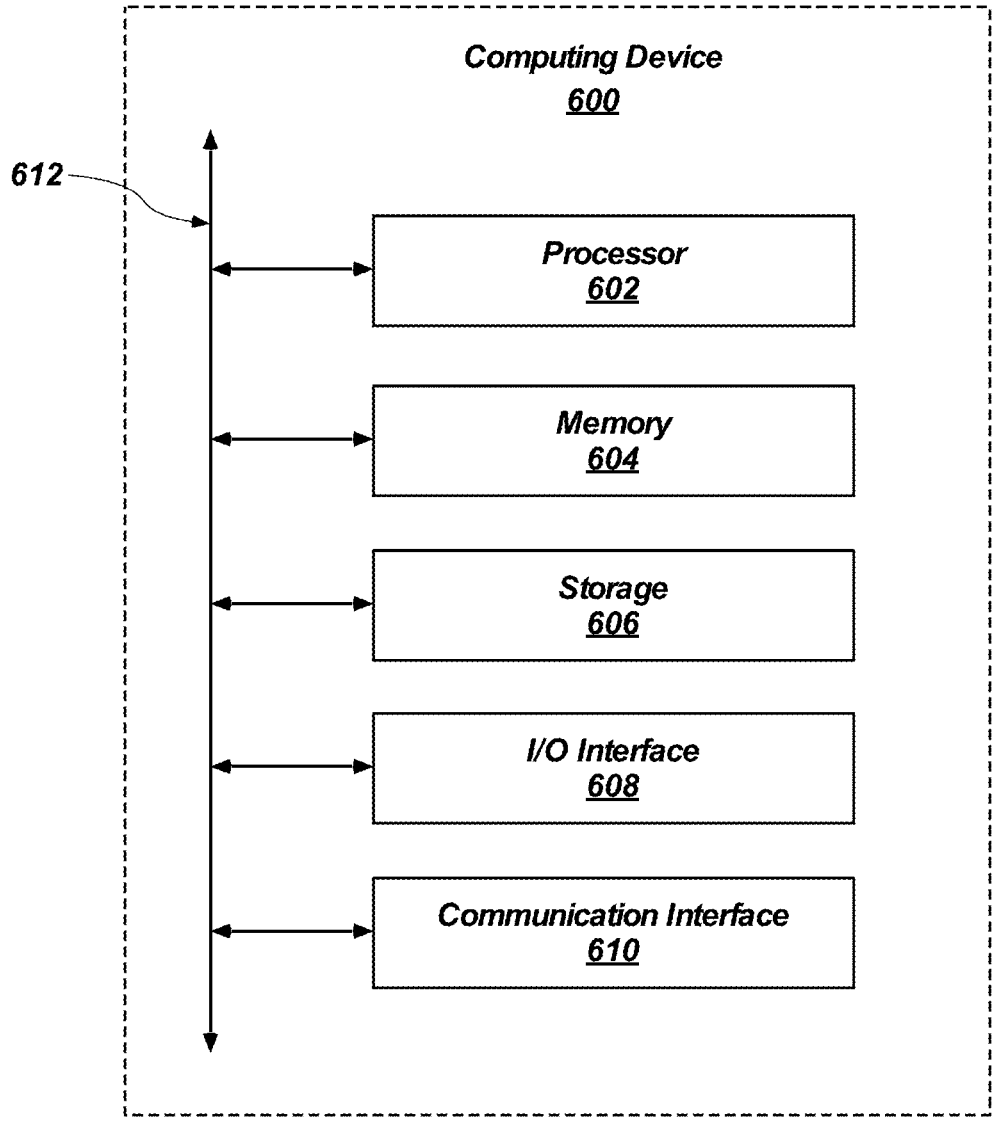
FIG. 6 is schematic diagram of a surface control unit of an embodiment of an earth-boring tool monitoring system of the present disclosure.

FIG. 6 is a block diagram of a surface control unit 128 and/or prediction system 129 according to one or more embodiments of the present disclosure. As shown in FIG. 6, in some embodiments, the surface control unit 128 and/or prediction system 129 may include an earth-boring tool monitoring system 600 (e.g., computing device). One will appreciate that one or more computing devices may implement the earth-boring tool monitoring system 600. The earth-boring tool monitoring system 600 can comprise a processor 602, a memory 604, a storage device 606, an I/O interface 608, and a communication interface 610, which may be communicatively coupled by way of a communication infrastructure 612. While an exemplary computing device is shown in FIG. 6, the components illustrated in FIG. 6 are not intended to be limiting. Additional or alternative components may be used in other embodiments. Furthermore, in certain embodiments, the computing device 600 can include fewer components than those shown in FIG. 6. Components of the computing device 600 shown in FIG. 6 will now be described in additional detail.

In one or more embodiments, the processor 602 includes hardware for executing instructions, such as those making up a computer program. As an example and not by way of limitation, to execute instructions, the processor 602 may retrieve (or fetch) the instructions from an internal register, an internal cache, the memory 604, or the storage device 606 and decode and execute them. In one or more embodiments, the processor 602 may include one or more internal caches for data, instructions, or addresses. As an example and not by way of limitation, the processor 602 may include one or more instruction caches, one or more data caches, and one or more translation lookaside buffers (TLBs). Instructions in the instruction caches may be copies of instructions in the memory 604 or the storage device 606.

The memory 604 may be used for storing data, metadata, and programs for execution by the processor(s). The memory 604 may include one or more of volatile and non-volatile memories, such as Random Access Memory ("RAM"), Read-Only Memory ("ROM"), a solid state disk ("SSD"), Flash memory, Phase Change Memory ("PCM"), or other types of data storage. The memory 604 may be internal or distributed memory.

The storage device 606 includes storage for storing data or instructions. As an example and not by way of limitation, storage device 606 can comprise a non-transitory storage medium described above. The storage device 606 may include a hard disk drive (HDD), a floppy disk drive, flash memory, an optical disc, a magneto-optical disc, magnetic tape, or a Universal Serial Bus (USB) drive or a combination of two or more of these. The storage device 606 may include removable or non-removable (or fixed) media, where appropriate. The storage device 606 may be internal or external to the computing device 600. In one or more embodiments, the storage device 606 is non-volatile, solid-state memory. In other embodiments, the storage device 606 includes read-only memory (ROM). Where appropriate, this ROM may be mask programmed ROM, programmable ROM (PROM), erasable PROM (EPROM), electrically erasable PROM (EEPROM), electrically alterable ROM (EAROM), or flash memory or a combination of two or more of these.

The I/O interface 608 allows a user to provide input to, receive output from, and otherwise transfer data to and receive data from computing device 600. The I/O interface 608 may include a mouse, a keypad or a keyboard, a touch screen, a camera, an optical scanner, network interface, modem, other known I/O devices or a combination of such I/O interfaces. The I/O interface 608 may include one or more devices for presenting output to a user, including, but not limited to, a graphics engine, a display (e.g., a display screen), one or more output drivers (e.g., display drivers), one or more audio speakers, and one or more audio drivers. In certain embodiments, the I/O interface 608 is configured to provide graphical data to a display for presentation to a user. The graphical data may be representative of one or more graphical user interfaces and/or any other graphical content as may serve a particular implementation.

The communication interface 610 can include hardware, software, or both. In any event, the communication interface 610 can provide one or more interfaces for communication (such as, for example, packet-based communication) between the computing device 600 and one or more other computing devices or networks. As an example and not by way of limitation, the communication interface 610 may include a network interface controller (NIC) or network adapter for communicating with an Ethernet or other wire-based network or a wireless NIC (WNIC) or wireless adapter for communicating with a wireless network, such as a WI-FI.

Additionally or alternatively, the communication interface 610 may facilitate communications with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, the communication interface 610 may facilitate communications with a wireless PAN (WPAN) (such as, for example, a BLUETOOTH® WPAN), a WI-FI network, a WI-MAX network, a cellular telephone network (such as, for example, a Global System for Mobile Communications (GSM) network), or other suitable wireless network or a combination thereof.

Additionally, the communication interface 610 may facilitate communications various communication protocols. Examples of communication protocols that may be used include, but are not limited to, data transmission media, communications devices, Transmission Control Protocol ("TCP"), Internet Protocol ("IP"), File Transfer Protocol ("FTP"), Telnet, Hypertext Transfer Protocol ("HTTP"), Hypertext Transfer Protocol Secure ("HTTPS"), Session Initiation Protocol ("SIP"), Simple Object Access Protocol ("SOAP"), Extensible Mark-up Language ("XML") and variations thereof, Simple Mail Transfer Protocol ("SMTP"), Real-Time Transport Protocol ("RTP"), User Datagram Protocol ("UDP"), Global System for Mobile Communications ("GSM") technologies, Code Division Multiple Access ("CDMA") technologies, Time Division Multiple Access ("TDMA") technologies, Short Message Service ("SMS"), Multimedia Message Service ("MMS"), radio frequency ("RF") signaling technologies, Long Term Evolution ("LTE") technologies, wireless communication technologies, in-band and out-of-band signaling technologies, and other suitable communications networks and technologies.

The communication infrastructure 612 may include hardware, software, or both that couples components of the computing device 600 to each other. As an example and not by way of limitation, the communication infrastructure 612 may include an Accelerated Graphics Port (AGP) or other graphics bus, an Enhanced Industry Standard Architecture (EISA) bus, a front-side bus (FSB), a HYPERTRANSPORT™ (HT) interconnect, an Industry Standard Architecture (ISA) bus, an INFINIBAND™ interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination thereof.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A method, comprising:

receiving input data;

training a hybrid physics and machine-learning model with the input data by building a coefficient library of drilling parameters of a planned drilling operation, comprising:

determining initial predictions of the drilling parameters of the planned drilling operation based on physics data within the input data; and determining relative influences and rankings of the drilling parameters of the planned drilling operation based on the physics data; and providing, via the hybrid physics and machine-learning model, a predictive model representing a rate of penetration of an earth-boring tool and wear of the earth-boring tool during the planned drilling operation.

2. The method of claim 1, further comprising providing one or more recommendations of the drilling parameters based on the predictive model.

3. The method claim 2, further comprising drilling a borehole based at least partially on the one or more recommendations of drilling parameters.

4. The method of claim 1, further comprising:

receiving real-time data from a drilling operation;

retraining the hybrid physics and machine-learning model based on a combination of the input data and the real-time data; and providing, via the retrained hybrid physics and machine-learning model, an updated predictive model of a rate of penetration of the earth-boring tool and wear of the earth-boring tool during a remainder of the planned drilling operation.

5. The method of claim 4, further comprising providing one or more updated recommendations of drilling parameters based on the updated predictive model.

6. The method claim 1, wherein training a hybrid physics and machine-learning model comprises:

identifying drilling parameters having the greatest uncertainties; and subjecting the drilling parameters to a parameter tuning process.

7. The method of claim 1, wherein providing a predictive model representing wear of the earth-boring tool comprises utilizing wear state characterization at a cutter level to predict wear of the earth-boring tool.

8. The method of claim 1, wherein the input data comprises offset well data and the physics data.

9. The method of claim 8, wherein the offset well data comprises one or more of formation logs, well architecture and design, surface and downhole data, bit and cutter design information, drilling system details, or bit dull information.

10. The method of claim 8, wherein the physics data comprises one or more of drill bit mechanics simulation models, three-dimensional geometry descriptions of earth-boring tools or formations, rock failure models, cutter-wear progression models, or cutter fracture criteria.

11. The method of claim 1, further comprising training a plurality of individual modules within the hybrid model.

12. The method of claim 11, wherein training the plurality of individual modules within the hybrid model comprises training at least a bit mechanics module, a cutter wear module, and a rate-of-penetration limiters module.

13. An earth-boring tool system, comprising:

a drilling assembly for drilling a wellbore; and a surface control unit operably coupled to the drilling assembly, the surface control unit comprising a prediction system, comprising:

at least one processor; and at least one non-transitory computer-readable storage medium storing instructions thereon that, when executed by the at least one processor, cause the prediction system to:

pre-train a plurality of modules individually within a hybrid physics and machine-learning model;

train the plurality of modules together to develop the hybrid physics and machine-learning model based on input data;

provide, via the hybrid physics and machine-learning model, a predictive model representing a rate of penetration of an earth-boring tool and wear of the earth-boring tool during a planned drilling operation;

provide one or more recommendations of drilling parameters based on the predictive model;

utilize the one or more recommendations in a drilling operation;

receive real-time data from the drilling operation;

retrain the hybrid physics and machine-learning model based on a combination of the input data and the real-time data; and provide, via the retrained hybrid physics and machine-learning model, an updated predictive model of a rate of penetration of the earth-boring tool and wear of the earth-boring tool during a remainder of the planned drilling operation.

14. The earth-boring tool system of claim 13, further comprising instructions that, when executed by the at least one processor, cause the prediction system to provide one or more updated recommendations of drilling parameters based on the updated predictive model.

15. The earth-boring tool system of claim 13, wherein providing a predictive model comprises analyzing the input data with one or more of physics models or machine-learning models of the hybrid physics and machine-learning model.

16. The earth-boring tool system of claim 15, wherein the machine-learning models are selected from a list consisting of a regression analysis, a classification analysis, a neural network, or an ensemble of machine-learning models.

17. A method, comprising:

receiving real-time data from a drilling operation at a trained hybrid physics and machine-learning model;

analyzing the real-time data via the hybrid physics and machine-learning model;

providing, via the hybrid physics and machine-learning model and based at least partially on the analysis, a predictive model representing a rate of penetration of an earth-boring tool and wear of the earth-boring tool throughout at least part of a remainder of the drilling operation;

providing one or more recommendations of drilling parameters based on the predictive model; and operating at least a portion of the drilling operation using the one or more recommendations of drilling parameters.

18. The method of claim 17, wherein the drilling operation comprises an operation that involves at least one of a build-up-rate, a turn rate, a lateral ROP, an unconfined compressive strength, a walk rate, a dog leg severity, a WOB, a confined compressive strength, a contact force, a rib force, a bending moment, a pressure, an inclination, an azimuth, a borehole trajectory, a drilling torque, drilling vibrations, or a hole quality.

19. The method of claim 17, wherein analyzing the real-time data comprises analyzing the real-time data with one or more of physics models or machine-learning models of the hybrid physics and machine-learning model.

20. The method of claim 17, further comprising continuously retraining the hybrid physics and machine-learning model with real-time data throughout a duration of the drilling operation.

* * * * *